US011361750B2

(12) United States Patent
Je et al.

(10) Patent No.: US 11,361,750 B2
(45) Date of Patent: Jun. 14, 2022

(54) SYSTEM AND ELECTRONIC DEVICE FOR GENERATING TTS MODEL

(71) Applicant: Samsung Electronics Co., Ltd., Gyeonggi-do (KR)

(72) Inventors: Seong Min Je, Gyeonggi-do (KR); Yong Joon Jeon, Gyeonggi-do (KR); Kyung Tae Kim, Gyeonggi-do (KR); June Sig Sung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 139 days.

(21) Appl. No.: 16/639,626

(22) PCT Filed: Aug. 22, 2018

(86) PCT No.: PCT/KR2018/009685
§ 371 (c)(1),
(2) Date: Feb. 17, 2020

(87) PCT Pub. No.: WO2019/039873
PCT Pub. Date: Feb. 28, 2019

(65) Prior Publication Data

US 2020/0243066 A1 Jul. 30, 2020

(30) Foreign Application Priority Data

Aug. 22, 2017 (KR) ..... KR10-2017-0106329

(51) Int. Cl.
*G10L 13/00* (2006.01)
*G10L 13/08* (2013.01)

(52) U.S. Cl.
CPC ..... *G10L 13/08* (2013.01)

(58) Field of Classification Search
None
See application file for complete search history.

(56) References Cited

U.S. PATENT DOCUMENTS

| | | | | |
|---|---|---|---|---|
| 7,209,882 | B1 * | 4/2007 | Cosatto | G10L 13/07 345/473 |
| 8,005,667 | B2 * | 8/2011 | Nhu | H04N 21/4263 704/211 |
| 8,571,871 | B1 * | 10/2013 | Stuttle | G10L 13/033 704/260 |
| 10,049,668 | B2 * | 8/2018 | Huang | G10L 15/285 |
| 10,170,116 | B1 * | 1/2019 | Kelly | G06F 3/167 |
| 10,365,887 | B1 * | 7/2019 | Mulherkar | G06F 3/167 |
| 10,522,134 | B1 * | 12/2019 | Matsoukas | G10L 15/01 |
| 10,692,485 | B1 * | 6/2020 | Grizzel | G10L 15/24 |
| 2002/0123897 | A1 * | 9/2002 | Matsumoto | G10L 13/06 704/500 |
| 2003/0055642 | A1 | 3/2003 | Harada | |
| 2004/0117181 | A1 * | 6/2004 | Morii | G10L 17/12 704/234 |

(Continued)

FOREIGN PATENT DOCUMENTS

| | | |
|---|---|---|
| JP | 06-102895 A | 4/1994 |
| JP | 3795409 B2 | 4/2006 |

(Continued)

*Primary Examiner* — Jakieda R Jackson
(74) *Attorney, Agent, or Firm* — Cha & Reiter, LLC

(57) ABSTRACT

Disclosed is an electronic device. Other various embodiments as understood from the specification are also possible.

14 Claims, 15 Drawing Sheets

(56) References Cited

U.S. PATENT DOCUMENTS

2005/0108013 A1* 5/2005 Karns ..... G10L 15/005 704/254
2007/0106685 A1* 5/2007 Houh ..... G06F 16/23
2008/0205279 A1* 8/2008 Chen ..... H04L 65/1009 370/235
2011/0035219 A1* 2/2011 Kadirkamanathan ..... G10L 15/005 704/239
2012/0136664 A1* 5/2012 Beutnagel ..... G10L 13/04 704/260
2012/0239404 A1* 9/2012 Nishiyama ..... G10L 13/033 704/260
2013/0124206 A1* 5/2013 Rezvani ..... G10L 13/08 704/270
2016/0062979 A1* 3/2016 Mote ..... G06F 16/90344 704/9
2016/0078859 A1* 3/2016 Luan ..... G10L 13/033 704/260
2016/0379638 A1* 12/2016 Basye ..... G10L 15/18 704/235
2017/0011745 A1* 1/2017 Navaratnam ..... G06Q 30/016
2017/0169811 A1* 6/2017 Sabbavarapu ..... G06F 3/165
2017/0270923 A1* 9/2017 Yamamoto ..... G10L 15/10
2017/0287465 A1* 10/2017 Zhao ..... G10L 13/086
2017/0365256 A1* 12/2017 Stylianou ..... G10L 15/20
2018/0054506 A1* 2/2018 Hart ..... H04M 1/271

FOREIGN PATENT DOCUMENTS

KR 2000-0036756 A 7/2000
KR 10-2015-0053276 A 5/2015
KR 10-2016-0030168 A 3/2016
KR 10-2016-0062588 A 6/2016

* cited by examiner

SYSTEM AND ELECTRONIC DEVICE FOR GENERATING TTS MODEL

CROSS REFERENCE TO RELATED APPLICATIONS

This application is a National Phase Entry of PCT International Application No. PCT/KR2018/009685, which was filed on Aug. 22, 2018, and claims a priority to Korean Patent Application No. 10-2017-0106329, which was filed on Aug. 22, 2017 the contents of which are incorporated herein by reference.

TECHNICAL FIELD

Embodiments disclosed in the disclosure relate to a technology for generating a TTS model.

BACKGROUND ART

Nowadays, various electronic devices may mount a text-to-speech (TTS) function, may convert a text into a voice, and may output the voice. For the purpose of providing the TTS function, an electronic device may use a TTS model including a phoneme of the text and voice data corresponding to the phoneme.

Various TTS models are required depending on a user's preference, and there is a demand for generating the TTS model by means of the user's own voice. For the purpose of generating such the TTS model, a talker needs to read the determined script and then may analyze voice data.

DISCLOSURE

Technical Problem

It may take a long time to generate a TTS model, and a talker needs to read a script including various phonemes constituting the TTS model.

Furthermore, when the TTS model is generated using a voice input, it is difficult to collect phonemes and voice data, which are enough to generate the TTS model.

According to various embodiments of the disclosure, it is possible to provide a device generating the personalized TTS model, using the voice command of a user.

Technical Solution

According to an embodiment disclosed in the disclosure, a system may include a network interface, at least one processor electrically connected to the network interface, and at least one memory electrically connected to the processor. The memory stores instructions that, when executed, cause the processor to perform at least one work, to store a phoneme extracted from the first data in a text-to-speech (TTS) database, and to determine whether a level associated with the number of the phoneme stored in the TTS database exceeds a first threshold value. The work may include receiving first data associated with a user utterance obtained through a microphone, from an external device including the microphone through the network interface, determining a sequence of states of the external device for performing the task, based at least partly on the first data, and transmitting information about the sequence of the states to the external device through the network interface. The user utterance may include a request for performing a task using the external device.

Furthermore, according to an embodiment disclosed in the disclosure, an electronic device may include a housing, a touch screen display disposed inside the housing and exposed through a first portion of the housing, a microphone disposed inside the housing and exposed through a second portion of the housing, a wireless communication circuit disposed inside the housing, a processor disposed inside the housing and electrically connected to the touch screen display, the microphone, and the wireless communication circuit, and a memory disposed inside the housing and electrically connected to the processor. The memory may store instructions that, when executed, cause the processor to receive first data including a text, which causes a user to generate an utterance to increase the number of types of a phoneme stored in an external server or a save count of the phoneme for each type, from the external server through the wireless communication circuit, to display the text through the touch screen display, to receive a user utterance associated with the displayed text, through the microphone, and to transmit second data associated with the received user utterance to an external server.

Moreover, according to an embodiment disclosed in the disclosure, a system may include a network interface, at least one processor electrically connected to the network interface, and at least one memory electrically connected to the processor. The memory may store instructions that, when executed, cause the processor to receive first data associated with a user utterance from an external device through the network interface, to store a phoneme extracted from the first data, in a voice data DB, and to provide second data to the external device through the network interface when a level associated with the number of the phoneme stored in the voice data DB exceeds a first threshold value. The second data may include a text, which causes a user to generate an utterance to increase the number of types of the stored phoneme or a save count of the phoneme for each type.

Advantageous Effects

According to embodiments disclosed in the disclosure, it is possible to generate a TTS model using a user utterance for voice commands.

Moreover, according to embodiments disclosed in the disclosure, it is possible to induce a user utterance for obtaining a phoneme needed to generate the TTS model.

Besides, a variety of effects directly or indirectly understood through the disclosure may be provided.

DESCRIPTION OF DRAWINGS

With regard to description of drawings, the same or similar components may be marked by the same or similar reference numerals.

MODE FOR INVENTION

Hereinafter, various embodiments of the disclosure will be described with reference to accompanying drawings. However, those of ordinary skill in the art will recognize that modification, equivalent, and/or alternative on various embodiments described herein can be variously made without departing from the scope and spirit of the disclosure.

Prior to describing an embodiment of the disclosure, an integrated intelligence system to which an embodiment of the disclosure is capable of being applied will be described.

Figure 1:
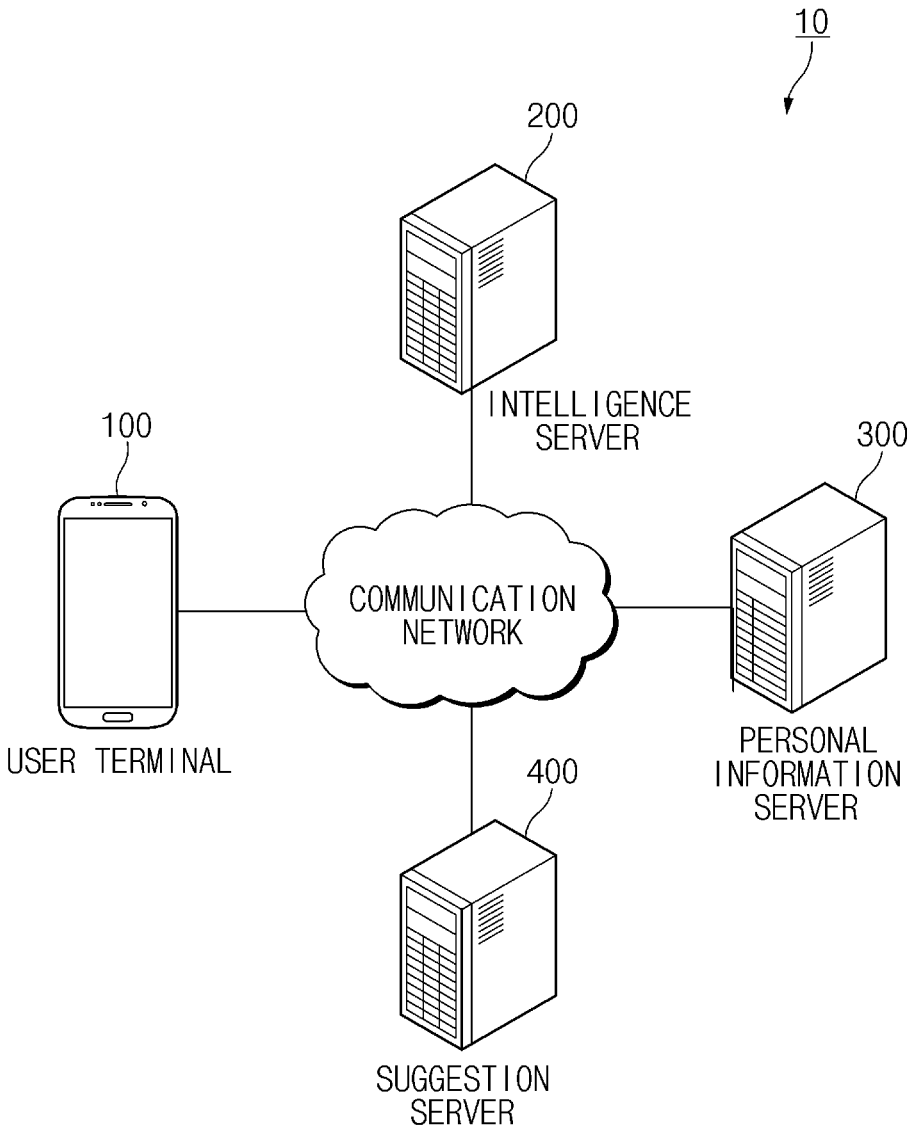
FIG. 1 is a view illustrating an integrated intelligence system, according to various embodiments of the disclosure.

FIG. 1 is a view illustrating an integrated intelligence system, according to various embodiments of the disclosure.

Referring to FIG. 1, an integrated intelligence system 10 may include a user terminal 100, an intelligence server 200, a personalization information server 300, or a suggestion server 400.

The user terminal 100 may provide a service necessary for a user through an app (or an application program) (e.g., an alarm app, a message app, a picture (gallery) app, or the like) stored in the user terminal 100. For example, the user terminal 100 may execute and operate another app through an intelligence app (or a speech recognition app) stored in the user terminal 100. The user terminal 100 may receive a user input for executing the other app and executing an action through the intelligence app of the user terminal 100. For example, the user input may be received through a physical button, a touch pad, a voice input, a remote input, or the like. According to an embodiment, various types of terminal devices (or an electronic device), which are connected with Internet, such as a mobile phone, a smartphone, personal digital assistant (PDA), a notebook computer, and the like may correspond to the user terminal 100.

According to an embodiment, the user terminal 100 may receive a user utterance as a user input. The user terminal 100 may receive the user utterance and may generate a command for operating an app based on the user utterance. As such, the user terminal 100 may operate the app, using the command.

The intelligence server 200 may receive a voice input of a user from the user terminal 100 over a communication network and may convert the voice input to text data. In another embodiment, the intelligence server 200 may generate (or select) a path rule based on the text data. The path rule may include information about an action (or an operation) for performing the function of an app or information about a parameter necessary to perform the action. In addition, the path rule may include the order of the action of the app. The user terminal 100 may receive the path rule, may select an app depending on the path rule, and may execute the action included in the path rule in the selected app.

Generally, the term "path rule" of the disclosure may mean, but not limited to, the sequence of states, which allows the electronic device to perform the task requested by the user. In other words, the path rule may include information about the sequence of the states. For example, the task may be a certain action that the intelligence app is capable of providing. The task may include the generation of a schedule, the transmission of a picture to the desired counterpart, or the provision of weather information. The user terminal 100 may perform the task by sequentially having at least one or more states (e.g., the operating state of the user terminal 100).

According to an embodiment, the path rule may be provided or generated by an artificial intelligent (AI) system. The AI system may be a rule-based system, or may be a neural network-based system (e.g., a feedforward neural network (FNN) or a recurrent neural network (RNN)). Alternatively, the AI system may be a combination of the above-described systems or an AI system different from the above-described system. According to an embodiment, the path rule may be selected from a set of predefined path rules or may be generated in real time in response to a user request. For example, the AI system may select at least a path rule of predefined plurality of path rules, or may generate a path rule dynamically (or in real time). Furthermore, the user terminal 100 may use a hybrid system to provide the path rule.

According to an embodiment, the user terminal 100 may execute the action and may display a screen corresponding to a state of the user terminal 100, which executes the action, in a display. For another example, the user terminal 100 may execute the action and may not display the result obtained by executing the action in the display. For example, the user terminal 100 may execute a plurality of actions and may display only the result of a part of the plurality of actions in the display. For example, the user terminal 100 may display only the result, which is obtained by executing the last action, on the display. For another example, the user terminal 100 may receive the user input to display the result obtained by executing the action in the display.

The personalization information server 300 may include a database in which user information is stored. For example, the personalization information server 300 may receive the user information (e.g., context information, execution of an app, or the like) from the user terminal 100 and may store the user information in the database. The intelligence server 200 may be used to receive the user information from the personalization information server 300 over the communication network and to generate a path rule associated with the user input. According to an embodiment, the user terminal 100 may receive the user information from the personalization information server 300 over the communication network, and may use the user information as information for managing the database.

The suggestion server 400 may include a database storing information about a function in a terminal, introduction of an application, or a function to be provided. For example, the suggestion server 400 may include a database associated with a function that a user utilizes by receiving the user information of the user terminal 100 from the personalization information server 300. The user terminal 100 may receive information about the function to be provided from the suggestion server 400 over the communication network and may provide the information to the user.

Figure 2:
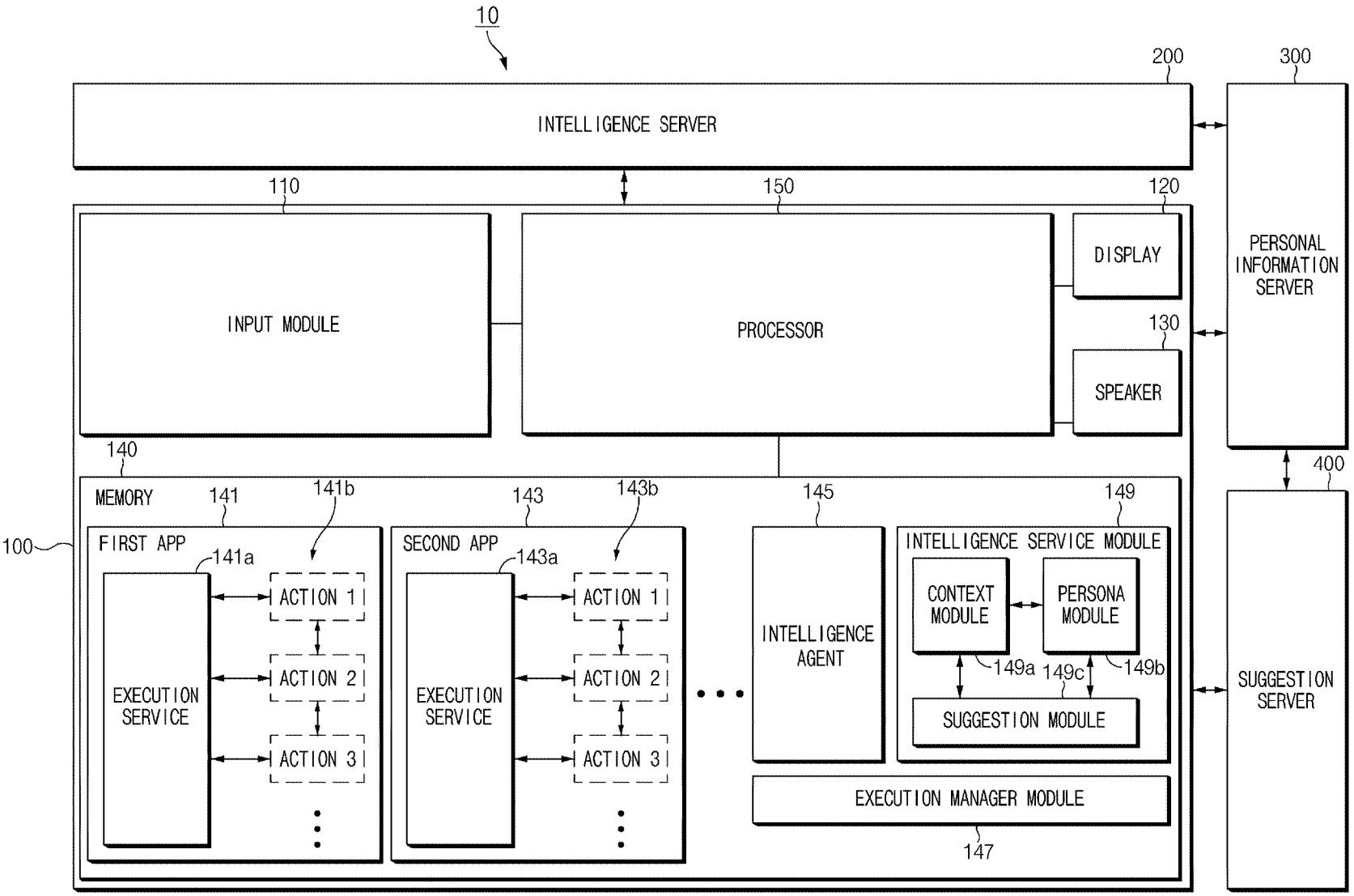
FIG. 2 is a block diagram illustrating a user terminal of an integrated intelligence system, according to an embodiment of the disclosure.

FIG. 2 is a block diagram illustrating a user terminal of an integrated intelligence system, according to an embodiment of the disclosure.

Referring to FIG. 2, the user terminal 100 may include an input module 110, a display 120, a speaker 130, a memory 140, or a processor 150. The user terminal 100 may further include housing, and components of the user terminal 100 may be seated in the housing or may be positioned on the housing. According to an embodiment, the user terminal 100 may further include a communication circuit positioned in the housing. The user terminal 100 may transmit or receive data (or information) to or from an external server (e.g., the intelligence server 200) through the communication circuit.

According to an embodiment, the input module 110 may receive a user input from a user. For example, the input module 110 may receive the user input from the connected external device (e.g., a keyboard or a headset). For another example, the input module 110 may include a touch screen (e.g., a touch screen display) coupled to the display 120. For another example, the input module 110 may include a hardware key (or a physical key) positioned in the user terminal 100 (or the housing of the user terminal 100).

According to an embodiment, the input module 110 may include a microphone that is capable of receiving the utterance of the user as a voice signal. For example, the input module 110 may include a speech input system and may receive the utterance of the user as a voice signal through the speech input system. For example, the microphone may be exposed through a part (e.g., a first portion) of the housing.

According to an embodiment, the display 120 may display an image, a video, and/or an execution screen of an application. For example, the display 120 may display a graphic user interface (GUI) of an app. According to an embodiment, the display 120 may be exposed to a part (e.g., a second part) of the housing.

According to an embodiment, the speaker 130 may output a voice signal. For example, the speaker 130 may output the voice signal generated in the user terminal 100 to the outside.

According to an embodiment, the memory 140 may store a plurality of apps (or application program) 141 and 143. For example, the plurality of apps 141 and 143 may be a program for performing a function corresponding to the user input. According to an embodiment, the memory 140 may store an intelligence agent 145, an execution manager module 147, or an intelligence service module 149. For example, the intelligence agent 145, the execution manager module 147, and the intelligence service module 149 may be a framework (or application framework) for processing the received user input (e.g., user utterance).

According to an embodiment, the memory 140 may include a database capable of storing information necessary to recognize the user input. For example, the memory 140 may include a log database capable of storing log information. For another example, the memory 140 may include a persona database capable of storing user information.

According to an embodiment, the memory 140 may store the plurality of apps 141 and 143, and the plurality of apps 141 and 143 may be loaded to operate. For example, the plurality of apps 141 and 143 stored in the memory 140 may operate after being loaded by the execution manager module 147. The plurality of apps 141 and 143 may include execution service modules 141*a* and 143*a* performing a function. In an embodiment, the plurality of apps 141 and 143 may perform a plurality of actions (e.g., a sequence of states) 141*b* and 143*b* through execution service modules 141*a* and 143*a* for the purpose of performing a function. In other words, the execution service modules 141*a* and 143*a* may be activated by the execution manager module 147, and then may execute the plurality of actions 141*b* and 143*b*.

According to an embodiment, when the actions 141*b* and 143*b* of the apps 141 and 143 are executed, an execution state screen according to the execution of the actions 141*b* and 143*b* may be displayed in the display 120. For example, the execution state screen may be a screen in a state where the actions 141*b* and 143*b* are completed. For another example, the execution state screen may be a screen in a state where the execution of the actions 141*b* and 143*b* is in partial landing (e.g., when a parameter necessary for the actions 141*b* and 143*b* are not entered).

According to an embodiment, the execution service modules 141*a* and 143*a* may execute the actions 141*b* and 143*b* depending on a path rule. For example, the execution service modules 141*a* and 143*a* may be activated by the execution manager module 147, may receive an execution request from the execution manager module 147 depending on the path rule, and may execute functions of the apps 141 and 143 by performing the actions 141*b* and 143*b* depending on the execution request. When the execution of the actions 141*b* and 143*b* is completed, the execution service modules 141*a* and 143*a* may transmit completion information to the execution manager module 147.

According to an embodiment, when the plurality of actions 141*b* and 143*b* are respectively executed in the apps 141 and 143, the plurality of actions 141*b* and 143*b* may be executed sequentially. When the execution of one action (e.g., action 1 of the first app 141 or action 1 of the second app 143) is completed, the execution service modules 141*a* and 143*a* may open the next action (e.g., action 2 of the first app 141 or action 2 of the second app 143) and may transmit the completion information to the execution manager module 147. Here, it is understood that opening an arbitrary action is to change a state of the arbitrary action to an executable state or to prepare the execution of the action. In other words, when the arbitrary action is not opened, the corresponding action may be not executed. When the completion information is received, the execution manager module 147 may transmit the execution request for the next action (e.g., action 2 of the first app 141 or action 2 of the second app 143) to the execution service module. According to an embodiment, when the plurality of apps 141 and 143 are executed, the plurality of apps 141 and 143 may be sequentially executed. For example, when receiving the completion information after the execution of the last action (e.g., action 3 of the first app 141) of the first app 141 is completed, the execution manager module 147 may transmit the execution request of the first action (e.g., action 1 of the second app 143) of the second app 143 to the execution service module 143*a*.

According to an embodiment, when the plurality of actions 141*b* and 143*b* are executed in the apps 141 and 143, the result screen according to the execution of each of the executed plurality of actions 141*b* and 143*b* may be displayed on the display 120. According to an embodiment, only a part of a plurality of result screens according to the executed plurality of actions 141*b* and 143*b* may be displayed on the display 120.

According to an embodiment, the memory 140 may store an intelligence app (e.g., a speech recognition app) operating in conjunction with the intelligence agent 145. The app operating in conjunction with the intelligence agent 145 may receive and process the utterance of the user as a voice signal. According to an embodiment, the app operating in conjunction with the intelligence agent 145 may be operated by a specific input (e.g., an input through a hardware key, an input through a touchscreen, or a specific voice input) input through the input module 110.

According to an embodiment, the intelligence agent 145, the execution manager module 147, or the intelligence service module 149 stored in the memory 140 may be performed by the processor 150. The functions of the intelligence agent 145, the execution manager module 147, or the intelligence service module 149 may be implemented by the processor 150. It is described that the function of each of the intelligence agent 145, the execution manager module 147, and the intelligence service module 149 is the operation of the processor 150. According to an embodiment, the intelligence agent 145, the execution manager module 147, or the intelligence service module 149 stored in the memory 140 may be implemented with hardware as well as software.

According to an embodiment, the processor 150 may control overall operations of the user terminal 100. For example, the processor 150 may control the input module 110 to receive the user input. The processor 150 may control the display 120 to display an image. The processor 150 may control the speaker 130 to output the voice signal. The processor 150 may control the memory 140 to execute a program and to read or store necessary information.

In an embodiment, the processor 150 may execute the intelligence agent 145, the execution manager module 147, or the intelligence service module 149 stored in the memory 140. As such, the processor 150 may implement the function of the intelligence agent 145, the execution manager module 147, or the intelligence service module 149.

According to an embodiment, the processor 150 may execute the intelligence agent 145 to generate an instruction for launching an app based on the voice signal received as the user input. According to an embodiment, the processor 150 may execute the execution manager module 147 to launch the apps 141 and 143 stored in the memory 140 depending on the generated instruction. According to an embodiment, the processor 150 may execute the intelligence service module 149 to manage information of a user and may process a user input, using the information of the user.

The processor 150 may execute the intelligence agent 145 to transmit a user input received through the input module 110 to the intelligence server 200 and may process the user input through the intelligence server 200.

According to an embodiment, before transmitting the user input to the intelligence server 200, the processor 150 may execute the intelligence agent 145 to pre-process the user input. According to an embodiment, to pre-process the user input, the intelligence agent 145 may include an adaptive echo canceller (AEC) module, a noise suppression (NS) module, an end-point detection (EPD) module, or an automatic gain control (AGC) module. The AEC may remove an echo included in the user input. The NS module may suppress a background noise included in the user input. The EPD module may detect an end-point of a user voice included in the user input and may search for a part in which the user voice is present, using the detected end-point. The AGC module may recognize the user input and may adjust the volume of the user input so as to be suitable to process the recognized user input. According to an embodiment, the processor 150 may execute all the pre-processing configurations for performance. However, in another embodiment, the processor 150 may execute a part of the pre-processing configurations to operate at low power.

According to an embodiment, the intelligence agent 145 may execute a wakeup recognition module stored in the memory 140 for the purpose of recognizing the call of a user. As such, the processor 150 may recognize the wakeup command of a user through the wakeup recognition module and may execute the intelligence agent 145 for receiving a user input when receiving the wakeup command. The wakeup recognition module may be implemented with a low-power processor (e.g., a processor included in an audio codec). According to an embodiment, when receiving a user input through a hardware key, the processor 150 may execute the intelligence agent 145. When the intelligence agent 145 is executed, an intelligence app (e.g., a speech recognition app) operating in conjunction with the intelligence agent 145 may be executed.

According to an embodiment, the intelligence agent 145 may include a speech recognition module for performing the user input. The processor 150 may recognize the user input for executing an action in an app through the speech recognition module. For example, the processor 150 may recognize a limited user (voice) input (e.g., an utterance such as "click" for performing a capture operation when a camera app is being executed) for performing an action such as the wakeup command in the apps 141 and 143 through the speech recognition module. For example, the processor 150 may assist the intelligence server 200 to recognize and rapidly process a user command capable of being processed in the user terminal 100 through the speech recognition module. According to an embodiment, the speech recognition module of the intelligence agent 145 for executing a user input may be implemented in an app processor.

According to an embodiment, the speech recognition module (including the speech recognition module of a wake up module) of the intelligence agent 145 may recognize the user input, using an algorithm for recognizing a voice. For example, the algorithm for recognizing the voice may be at least one of a hidden Markov model (HMM) algorithm, an artificial neural network (ANN) algorithm, or a dynamic time warping (DTW) algorithm.

According to an embodiment, the processor 150 may execute the intelligence agent 145 to convert the voice input of the user into text data. For example, the processor 150 may transmit the voice of the user to the intelligence server 200 through the intelligence agent 145 and may receive the text data corresponding to the voice of the user from the intelligence server 200. As such, the processor 150 may display the converted text data on the display 120.

According to an embodiment, the processor 150 may execute the intelligence agent 145 to receive a path rule from the intelligence server 200. According to an embodiment, the processor 150 may transmit the path rule to the execution manager module 147 through the intelligence agent 145.

According to an embodiment, the processor 150 may execute the intelligence agent 145 to transmit the execution result log according to the path rule received from the intelligence server 200 to the intelligence service module 149, and the transmitted execution result log may be accumulated and managed in preference information of the user of a persona module 149*b*.

According to an embodiment, the processor 150 may execute the execution manager module 147, may receive the path rule from the intelligence agent 145, and may execute the apps 141 and 143; and the processor 150 may allow the apps 141 and 143 to execute the actions 141*b* and 143*b* included in the path rule. For example, the processor 150 may transmit command information (e.g., path rule information) for executing the actions 141*b* and 143*b* to the apps 141 and 143, through the execution manager module 147; and the processor 150 may receive completion information of the actions 141*b* and 143*b* from the apps 141 and 143.

According to an embodiment, the processor 150 may execute the execution manager module 147 to transmit the command information (e.g., path rule information) for executing the actions 141*b* and 143*b* of the apps 141 and 143 between the intelligence agent 145 and the apps 141 and 143. The processor 150 may bind the apps 141 and 143 to be executed depending on the path rule through the execution manager module 147 and may transmit the command information (e.g., path rule information) of the actions 141*b* and 143*b* included in the path rule to the apps 141 and 143. For example, the processor 150 may sequentially transmit the actions 141*b* and 143*b* included in the path rule to the apps 141 and 143, through the execution manager module 147 and may sequentially execute the actions 141*b* and 143*b* of the apps 141 and 143 depending on the path rule.

According to an embodiment, the processor 150 may execute the execution manager module 147 to manage execution states of the actions 141*b* and 143*b* of the apps 141 and 143. For example, the processor 150 may receive information about the execution states of the actions 141*b* and 143*b* from the apps 141 and 143, through the execution manager module 147. For example, when the execution states of the actions 141*b* and 143*b* are in partial landing (e.g., when a parameter necessary for the actions 141*b* and 143*b* are not input), the processor 150 may transmit information about the partial landing to the intelligence agent 145, through the execution manager module 147. The processor 150 may make a request for an input of necessary information (e.g., parameter information) to the user by using the received information through the intelligence agent 145. For another example, when the execution state of each of the actions 141*b* and 143*b* is an operating state, the processor 150 may receive an utterance from the user through the intelligence agent 145. The processor 150 may transmit information about the apps 141 and 143 being executed and the execution states of the apps 141 and 143 to the intelligence agent 145, through the execution manager module 147. The processor 150 may transmit the user utterance to the intelligence server 200 through the intelligence agent 145. The processor 150 may receive parameter information of the utterance of the user from the intelligence server 200 through the intelligence agent 145. The processor 150 may transmit the received parameter information to the execution manager module 147 through the intelligence agent 145. The execution manager module 147 may change a parameter of each of the actions 141*b* and 143*b* to a new parameter by using the received parameter information.

According to an embodiment, the processor 150 may execute the execution manager module 147 to transmit parameter information included in the path rule to the apps 141 and 143. When the plurality of apps 141 and 143 are sequentially executed depending on the path rule, the execution manager module 147 may transmit the parameter information included in the path rule from one app to another app.

According to an embodiment, the processor may execute the execution manager module 147 to receive a plurality of path rules. The processor 150 may select a plurality of path rules based on the utterance of the user, through the execution manager module 147. For example, when the user utterance specifies a partial app 141 executing a partial action 141*b* but does not specify the other app 143 executing the remaining action 143*b*, the processor 150 may receive a plurality of different path rules, in which the same app 141 (e.g., a gallery app) executing the partial action 141*b* is executed and the different app 143 (e.g., a message app or a Telegram app) executing the remaining action 143*b* is executed, through the execution manager module 147. For example, the processor 150 may execute the same actions 141*b* and 143*b* (e.g., the same successive actions 141*b* and 143*b*) of the plurality of path rules, through the execution manager module 150. When the processor 150 executes the same action, the processor 150 may display a state screen for selecting the different apps 141 and 143 respectively included in the plurality of path rules in the display 120, through the execution manager module 147.

According to an embodiment, the intelligence service module 149 may include a context module 149*a*, a persona module 149*b*, or a suggestion module 149*c*.

The context module 149*a* may collect current states of the apps 141 and 143 from the apps 141 and 143. For example, the context module 149*a* may receive context information indicating the current states of the apps 141 and 143 to collect the current states of the apps 141 and 143.

The persona module 149*b* may manage personal information of the user utilizing the user terminal 100. For example, the persona module 149*b* may collect the usage information and the execution result of the user terminal 100 to manage personal information of the user.

The suggestion module 149*c* may predict the intent of the user to recommend a command to the user. For example, the suggestion module 149*c* may recommend a command to the user in consideration of the current state (e.g., a time, a place, a situation, or an app) of the user.

Figure 3:
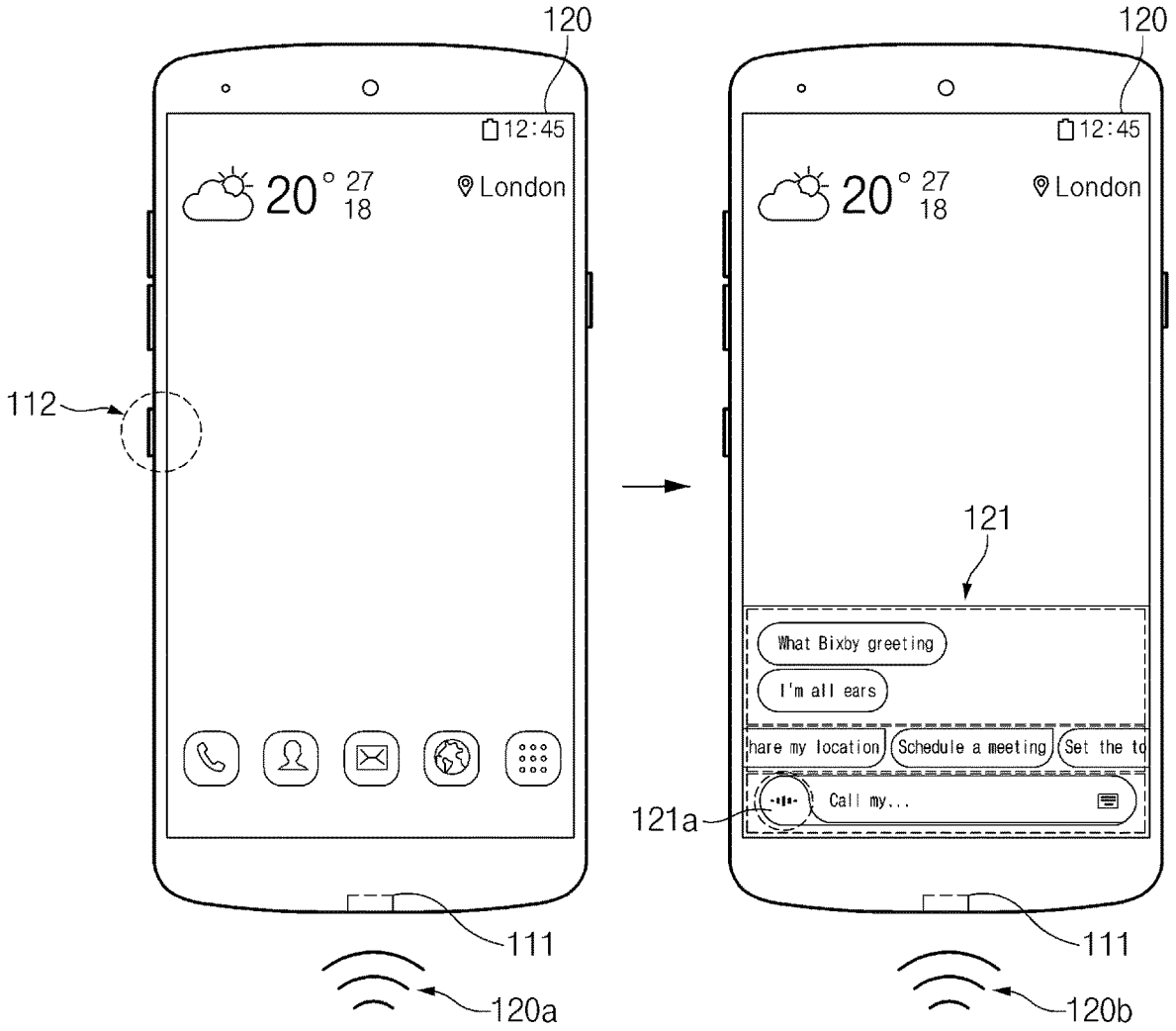
FIG. 3 is a view illustrating that an intelligence app of a user terminal is executed, according to an embodiment of the disclosure.

FIG. 3 is a view illustrating that an intelligence app of a user terminal is executed, according to an embodiment of the disclosure.

FIG. 3 illustrates that the user terminal 100 receives a user input to execute an intelligence app (e.g., a speech recognition app) operating in conjunction with the intelligence agent 145.

According to an embodiment, the user terminal 100 may execute the intelligence app for recognizing a voice through a hardware key 112. For example, when the user terminal 100 receives the user input through the hardware key 112, the user terminal 100 may display a UI 121 of the intelligence app on the display 120. For example, a user may touch a speech recognition button 121*a* on the UI 121 of the intelligence app for the purpose of entering (120*b*) a voice in a state where the UI 121 of the intelligence app is displayed on the display 120. For another example, while continuously pressing the hardware key 112 to enter (120*b*) the voice, the user may enter (120*b*) the voice.

According to an embodiment, the user terminal 100 may execute the intelligence app for recognizing a voice through the microphone 111. For example, when a specified voice (e.g., wake up!) is entered (120*a*) through the microphone 111, the user terminal 100 may display the UI 121 of the intelligence app on the display 120.

Figure 4:
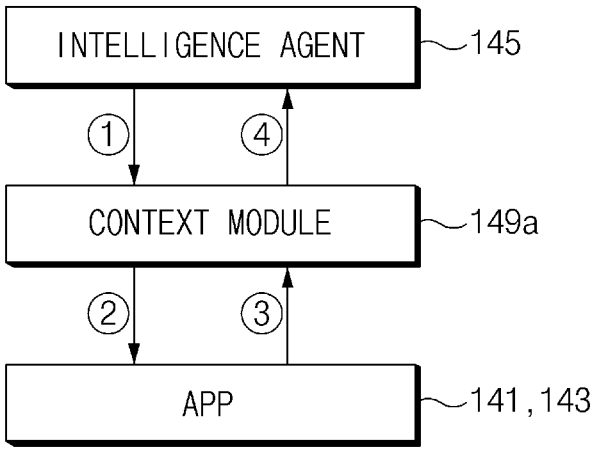
FIG. 4 is a block diagram illustrating that a context module of an intelligence service module collects a current state, according to an embodiment of the disclosure.

FIG. 4 is a block diagram illustrating that a context module of an intelligence service module collects a current state, according to an embodiment of the disclosure. The processor 150 may implement the intelligence agent 145, the context module 149*a*, and the apps 141 and 143 by executing instructions stored in the memory 140. Accordingly, it is understood that the operation executed by the intelligence agent 145, the context module 149*a*, and the apps 141 and 143 is performed by the processor 150.

Referring to FIG. 4, when receiving (①) a context request from the intelligence agent 145, the context module 149*a* may make a request (②) for context information indicating current states of the apps 141 and 143 to the apps 141 and 143. According to an embodiment, the context module 149*a* may receive (③) the context information from the apps 141 and 143 and may transmit (④) the context information to the intelligence agent 145.

According to an embodiment, the context module 149*a* may receive pieces of context information through the apps 141 and 143. For example, the context information may be information about the most recently executed apps 141 and 143. For another example, the context information may be information (e.g., information about the corresponding picture when a user watches a picture through a gallery app) about the current states in the apps 141 and 143.

According to an embodiment, the context module 149*a* may receive context information indicating a current state of the user terminal 100 from a device platform as well as the apps 141 and 143. The context information may include general context information, user context information, or device context information.

The general context information may include general information of the user terminal 100. The general context information may be identified through an internal algorithm by receiving data through a sensor hub of the device platform or the like. For example, the general context information may include information about current time and space. For example, the information about the current time and space may include information about current time or a current location of the user terminal 100. The current time may be identified through the time on the user terminal 100, and the information about the current location may be identified through a global positioning system (GPS). For another example, the general context information may include information about physical motion. For example, the information about the physical motion may include information about walking, running, driving, or the like. The information about the physical motion may be identified through a motion sensor. The information about the driving may be identified by sensing Bluetooth connection in a vehicle such that boarding and parking is identified as well as identifying the driving through the motion sensor. For another example, the general context information may include user activity information. For example, the user activity information may include information about commuting, shopping, travel, or the like. The user activity information may be identified by using information about a place where a user or an app registers in a database.

The user context information may include information about the user. For example, the user context information may include information about an emotional state of the user. For example, the information about the emotional state of the user may include information about happiness, sadness, anger, or the like of the user. For another example, the user context information may include information about the current state of the user. For example, the information about the current state of the user may include information about interest, intent, or the like (e.g., shopping).

The device context information may include information about the state of the user terminal 100. For example, the device context information may include information about a path rule performed by the execution manager module 147. For another example, the device information may include information about a battery. For example, the information about the battery may be identified through charging and discharging states of the battery. For another example, the device information may include information about a connected device and a network. For example, the information about the connected device may be identified through a communication interface connected with the device.

Figure 5:
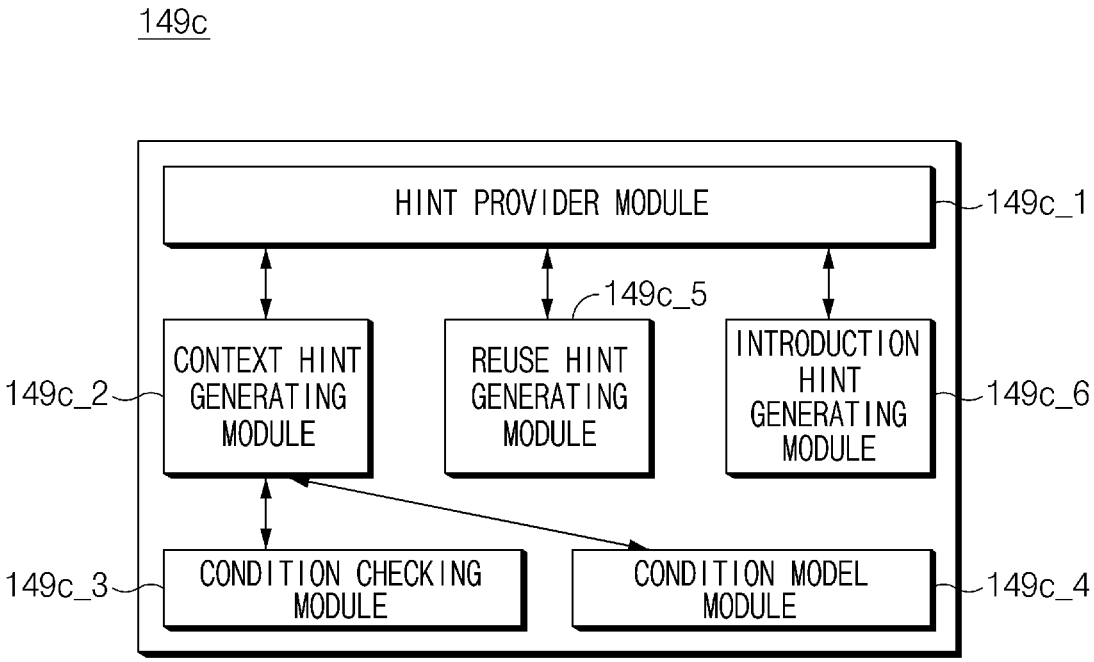
FIG. 5 is a block diagram illustrating a suggestion module of an intelligence service module, according to an embodiment of the disclosure.

FIG. 5 is a block diagram illustrating a suggestion module of an intelligence service module, according to an embodiment of the disclosure. The processor 150 may implement a hint provider module 149*c*_1, a context hint generating module 149*c*_2, a condition checking module 149*c*_3, a condition model module 149*c*_4, a reuse hint generating module 149*c*_5, or an introduction hint generating module 149*c*_6 by executing instructions stored in the memory 140. Accordingly, it is understood that the operation performed by modules described below is performed by the processor 150.

Referring to FIG. 5, the suggestion module 149*c* may include the hint provider module 149*c*_1, the context hint generating module 149*c*_2, the condition checking module 149*c*_3, the condition model module 149*c*_4, the reuse hint generating module 149*c*_5, or the introduction hint generating module 149*c*_6.

According to an embodiment, the hint provider module 149*c*_1 may provide a user with a hint. For example, the hint provider module 149*c*_1 may receive the generated hint from the context hint generating module 149*c*_2, the reuse hint generating module 149*c*_5 or the introduction hint generating module 149*c*_6, to provide the user with the hint.

According to an embodiment, the context hint generating module 149*c*_2 may generate a hint that is recommended depending on a current state through the condition checking module 149*c*_3 or the condition model module 149*c*_4. The condition checking module 149*c*_3 may receive information corresponding to the current state through the intelligence service module 149, and the condition model module 149*c*_4 may set a condition model by using the received information. For example, the condition model module 149*c*_4 may provide the user with a hint, which is likely to be used under the corresponding condition, in order of priority by grasping a time, a location, a situation, an app being executed, or the like at a point in time when the hint is provided to the user.

According to an embodiment, the reuse hint generating module 149*c*_5 may generate a hint that is to be recommended depending on the current state and use frequency. For example, the reuse hint generating module 149*c*_5 may generate the hint in consideration of the use pattern of the user.

According to an embodiment, the introduction hint generating module 149*c*_6 may generate a hint for introducing a new function and a function, which is most frequently used by another user, to the user. For example, the hint for introducing the new function may include introduction (e.g., an operating method) associated with the intelligence agent 145.

According to another embodiment, the personalization information server 300 may include the context hint generating module 149*c*_2, the condition checking module 149*c*_3, the condition model module 149*c*_4, the reuse hint generating module 149*c*_5, or the introduction hint generating module 149*c*_6 of the suggestion module 149*c*. For example, the hint provider module 149*c*_1 of the suggestion module 149*c* may receive the hint from the context hint generating module 149*c*_2, the reuse hint generating module 149*c*_5, or the introduction hint generating module 149*c*_6 of the personalization information server 300 to provide the user with the received hint.

According to an embodiment, the user terminal 100 may provide the hint depending on the following series of processes. For example, when receiving a hint providing request from the intelligence agent 145, the hint provider module 149*c*_1 may transmit a hint generating request to the context hint generating module 149*c*_2. When receiving the hint generating request, the context hint generating module 149*c*_2 may receive information corresponding to the current state from the context module 149*a* and the persona module 149*b*, using the condition checking module 149*c*_3. The condition checking module 149*c*_3 may transmit the received information to the condition model module 149*c*_4, and the condition model module 149*c*_4 may assign a priority to a hint among hints to be provided to the user, in order of high availability under a condition by using the information. The context hint generating module 149*c*_2 may identify the condition and may generate a hint corresponding to the current state. The context hint generating module 149*c*_2 may transmit the generated hint to the hint provider module 149*c*_1. The hint provider module 149*c*_1 may sort the hint depending on the specified rule and may transmit the hint to the intelligence agent 145.

According to an embodiment, the hint provider module 149*c*_1 may generate a plurality of context hints and may assign priorities to the plurality of context hints depending on the specified rule. According to an embodiment, the hint provider module 149*c*_1 may provide the user with a context hint, the priority of which is high, from among the plurality of context hints at first.

According to an embodiment, the user terminal 100 may suggest a hint according to the use frequency. For example, when receiving a hint providing request from the intelligence agent 145, the hint provider module 149*c*_1 may transmit a hint generating request to the reuse hint generating module 149*c*_5. When receiving the hint generating request, the reuse hint generating module 149*c*_5 may receive user information from the persona module 149*b*. For example, the reuse hint generating module 149*c*_5 may receive a path rule included in preference information of the user of the persona module 149*b*, a parameter included in the path rule, an execution frequency of an app, and information about time and space in which the app is used. The reuse hint generating module 149*c*_5 may generate a hint corresponding to the received user information. The reuse hint generating module 149*c*_5 may transmit the generated hint to the hint provider module 149*c*_1. The hint provider module 149*c*_1 may sort the hint and may transmit the hint to the intelligence agent 145.

According to an embodiment, the user terminal 100 may suggest a hint associated with a new function. For example, when receiving a hint providing request from the intelligence agent 145, the hint provider module 149*c*_1 may transmit a hint generating request to the introduction hint generating module 149*c*_6. The introduction hint generating module 149*c*_6 may transmit an introduction hint provision request to the suggestion server 400 and may receive information about a function to be introduced from the suggestion server 400. For example, the suggestion server 400 may store the information about the function to be introduced, and a hint list associated with the function to be introduced may be updated by a service operator. The introduction hint generating module 149*c*_6 may transmit the generated hint to the hint provider module 149*c*_1. The hint provider module 149*c*_1 may sort the hint and may transmit the hint to the intelligence agent 145.

As such, the suggestion module 149*c* may provide a user with a hint generated by the context hint generating module 149*c*_2, the reuse hint generating module 149*c*_5, or the introduction hint generating module 149*c*_6. For example, the suggestion module 149*c* may display the generated hint in an app operating the intelligence agent 145 and may receive an input for selecting the hint from the user through the app.

Figure 6:
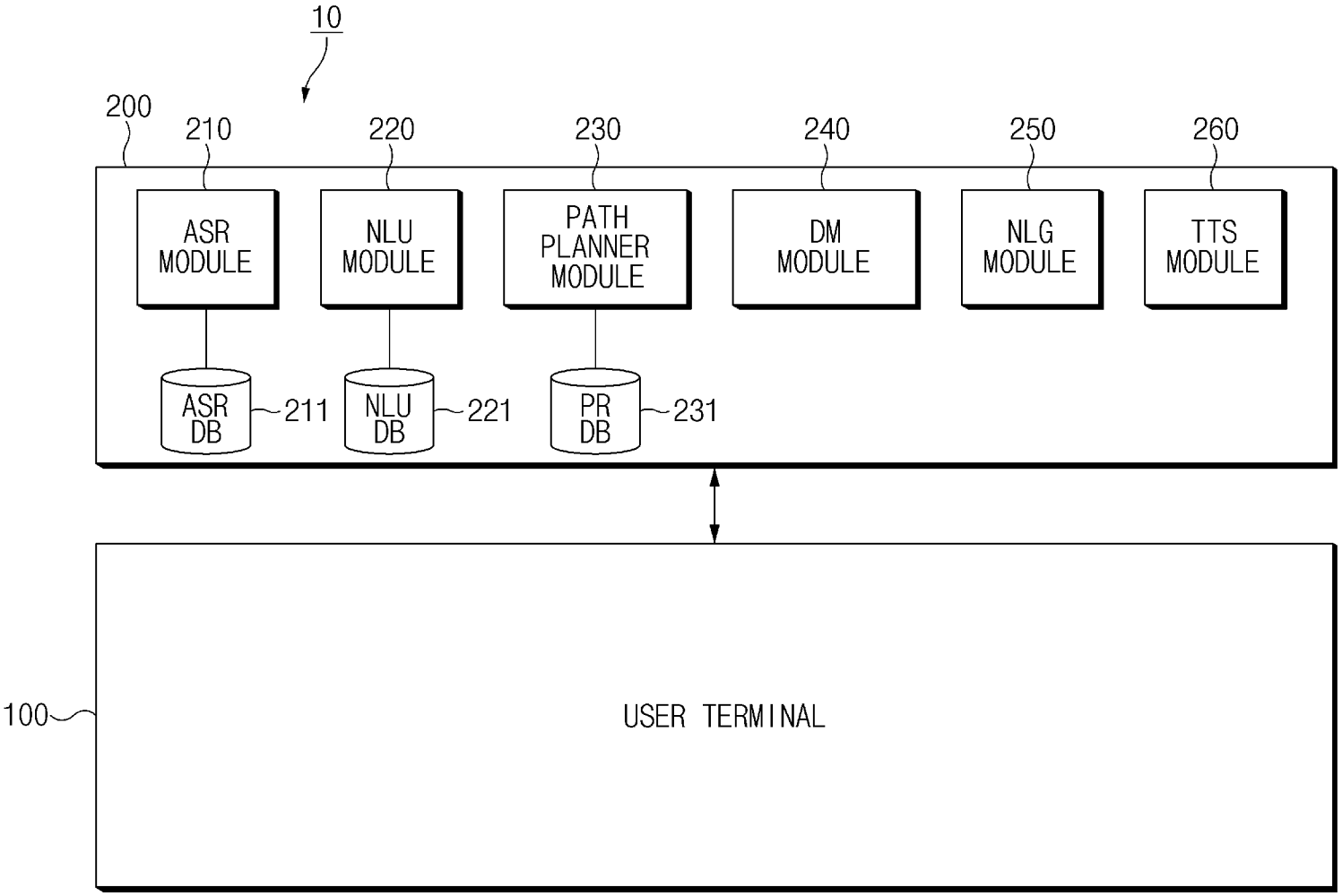
FIG. 6 is a block diagram illustrating an intelligence server of an integrated intelligence system, according to an embodiment of the disclosure.

FIG. 6 is a block diagram illustrating an intelligence server of an integrated intelligence system, according to an embodiment of the disclosure.

Referring to FIG. 6, the intelligence server 200 may include an automatic speech recognition (ASR) module 210, a natural language understanding (NLU) module 220, a path planner module 230, a dialogue manager (DM) module 240, a natural language generator (NLG) module 250, or a text to speech (TTS) module 260. According to an embodiment, the intelligence server 200 may include a communication circuit, a memory, and a processor. The processor may execute an instruction stored in the memory to drive the ASR module 210, the NLU module 220, the path planner module 230, the DM module 240, the NLG module 250, and the TTS module 260. The intelligence server 200 may transmit or receive data (or information) to or from an external electronic device (e.g., the user terminal 100) through the communication circuit.

The NLU module 220 or the path planner module 230 of the intelligence server 200 may generate a path rule.

According to an embodiment, the ASR module 210 may change the user input received from the user terminal 100 to text data.

According to an embodiment, the ASR module 210 may convert the user input received from the user terminal 100 to text data. For example, the ASR module 210 may include a speech recognition module. The speech recognition module may include an acoustic model and a language model. For example, the acoustic model may include information associated with phonation, and the language model may include unit phoneme information and information about a combination of unit phoneme information. The speech recognition module may convert a user utterance into text data, using the information associated with phonation and unit phoneme information. For example, the information about the acoustic model and the language model may be stored in an automatic speech recognition database (ASR DB) 211.

According to an embodiment, the NLU module 220 may grasp user intent by performing syntactic analysis or semantic analysis. The syntactic analysis may divide the user input into syntactic units (e.g., words, phrases, morphemes, and the like) and determine which syntactic elements the divided units have. The semantic analysis may be performed by using semantic matching, rule matching, formula matching, or the like. As such, the NLU module 220 may obtain a domain, intent, or a parameter (or a slot) necessary to express the intent, from the user input.

According to an embodiment, the NLU module 220 may determine the intent of the user and parameter by using a matching rule that is divided into a domain, intent, and a parameter (or a slot) necessary to grasp the intent. For example, the one domain (e.g., an alarm) may include a plurality of intent (e.g., alarm settings, alarm cancellation, and the like), and one intent may include a plurality of parameters (e.g., a time, the number of iterations, an alarm sound, and the like). For example, the plurality of rules may include one or more necessary parameters. The matching rule may be stored in a natural language understanding database (NLU DB) 221.

According to an embodiment, the NLU module 220 may grasp the meaning of words extracted from a user input by using linguistic features (e.g., syntactic elements) such as morphemes, phrases, and the like and may match the grasped meaning of the words to the domain and intent to determine user intent. For example, the NLU module 220 may calculate how many words extracted from the user input is included in each of the domain and the intent, for the purpose of determining the user intent. According to an embodiment, the NLU module 220 may determine a parameter of the user input by using the words, which are based for grasping the intent. According to an embodiment, the NLU module 220 may determine the user intent by using the NLU DB 221 storing the linguistic features for grasping the intent of the user input. According to another embodiment, the NLU module 220 may determine the user intent by using a personal language model (PLM). For example, the NLU module 220 may determine the user intent by using the personalized information (e.g., a contact list or a music list). For example, the PLM may be stored in the NLU DB 221. According to an embodiment, the ASR module 210 as well as the NLU module 220 may recognize the voice of the user with reference to the PLM stored in the NLU DB 221.

According to an embodiment, the NLU module 220 may generate a path rule based on the intent of the user input and the parameter. For example, the NLU module 220 may select an app to be executed, based on the intent of the user input and may determine an action to be executed, in the selected app. The NLU module 220 may determine the parameter corresponding to the determined action to generate the path rule. According to an embodiment, the path rule generated by the NLU module 220 may include information about the app to be executed, the action (e.g., at least one or more states) to be executed in the app, and a parameter necessary to execute the action.

According to an embodiment, the NLU module 220 may generate one path rule, or a plurality of path rules based on the intent of the user input and the parameter. For example, the NLU module 220 may receive a path rule set corresponding to the user terminal 100 from the path planner module 230 and may map the intent of the user input and the parameter to the received path rule set to determine the path rule.

According to another embodiment, the NLU module 220 may determine the app to be executed, the action to be executed in the app, and a parameter necessary to execute the action based on the intent of the user input and the parameter for the purpose of generating one path rule or a plurality of path rules. For example, the NLU module 220 may arrange the app to be executed and the action to be executed in the app by using information of the user terminal 100 depending on the intent of the user input in the form of ontology or a graph model for the purpose of generating the path rule. For example, the generated path rule may be stored in a path rule database (PR DB) 231 through the path planner module 230. The generated path rule may be added to a path rule set of the DB 231.

According to an embodiment, the NLU module 220 may select at least one path rule of the generated plurality of path rules. For example, the NLU module 220 may select an optimal path rule of the plurality of path rules. For another example, when only a part of action is specified based on the user utterance, the NLU module 220 may select a plurality of path rules. The NLU module 220 may determine one path rule of the plurality of path rules depending on an additional input of the user.

According to an embodiment, the NLU module 220 may transmit the path rule to the user terminal 100 at a request for the user input. For example, the NLU module 220 may transmit one path rule corresponding to the user input to the user terminal 100. For another example, the NLU module 220 may transmit the plurality of path rules corresponding to the user input to the user terminal 100. For example, when only a part of action is specified based on the user utterance, the plurality of path rules may be generated by the NLU module 220.

According to an embodiment, the path planner module 230 may select at least one path rule of the plurality of path rules.

According to an embodiment, the path planner module 230 may transmit a path rule set including the plurality of path rules to the NLU module 220. The plurality of path rules of the path rule set may be stored in the PR DB 231 connected to the path planner module 230 in the table form. For example, the path planner module 230 may transmit a path rule set corresponding to information (e.g., OS information or app information) of the user terminal 100, which is received from the intelligence agent 145, to the NLU module 220. For example, a table stored in the PR DB 231 may be stored for each domain or for each version of the domain.

According to an embodiment, the path planner module 230 may select one path rule or the plurality of path rules from the path rule set to transmit the selected one path rule or the selected plurality of path rules to the NLU module 220. For example, the path planner module 230 may match the user intent and the parameter to the path rule set corresponding to the user terminal 100 to select one path rule or a plurality of path rules and may transmit the selected one path rule or the selected plurality of path rules to the NLU module 220.

According to an embodiment, the path planner module 230 may generate the one path rule or the plurality of path rules by using the user intent and the parameter. For example, the path planner module 230 may determine the app to be executed and the action to be executed in the app based on the user intent and the parameter for the purpose of generating the one path rule or the plurality of path rules. According to an embodiment, the path planner module 230 may store the generated path rule in the PR DB 231.

According to an embodiment, the path planner module 230 may store the path rule generated by the NLU module 220 in the PR DB 231. The generated path rule may be added to the path rule set stored in the PR DB 231.

According to an embodiment, the table stored in the PR DB 231 may include a plurality of path rules or a plurality of path rule sets. The plurality of path rules or the plurality of path rule sets may reflect the kind, version, type, or characteristic of a device performing each path rule.

According to an embodiment, the DM module 240 may determine whether the user intent grasped by the NLU module 220 is definite. For example, the DM module 240 may determine whether the user intent is clear, based on whether the information of a parameter is sufficient. The DM module 240 may determine whether the parameter grasped by the NLU module 220 is sufficient to perform a task. According to an embodiment, when the user intent is not clear, the DM module 240 may perform a feedback for making a request for necessary information to the user. For example, the DM module 240 may perform a feedback for making a request for information about the parameter for grasping the user intent.

According to an embodiment, the DM module 240 may include a content provider module. When the content provider module executes an action based on the intent and the parameter grasped by the NLU module 220, the content provider module may generate the result obtained by performing a task corresponding to the user input. According to an embodiment, the DM module 240 may transmit the result generated by the content provider module as the response to the user input to the user terminal 100.

According to an embodiment, the NLG module 250 may change specified information to a text form. The information changed to the text form may be a form of a natural language speech. For example, the specified information may be information about an additional input, information for guiding the completion of an action corresponding to the user input, or information for guiding the additional input of the user (e.g., feedback information about the user input). The information changed to the text form may be displayed in the display 120 after being transmitted to the user terminal 100 or may be changed to a voice form after being transmitted to the TTS module 260.

According to an embodiment, the TTS module 260 may change information of the text form to information of a voice form. The TTS module 260 may receive the information of the text form from the NLG module 250, may change the information of the text form to the information of a voice form, and may transmit the information of the voice form to the user terminal 100. The user terminal 100 may output the information of the voice form to the speaker 130

According to an embodiment, the NLU module 220, the path planner module 230, and the DM module 240 may be implemented with one module. For example, the NLU module 220, the path planner module 230, and the DM module 240 may be implemented with one module, may determine the user intent and the parameter, and may generate a response (e.g., a path rule) corresponding to the determined user intent and parameter. As such, the generated response may be transmitted to the user terminal 100.

Figure 7:
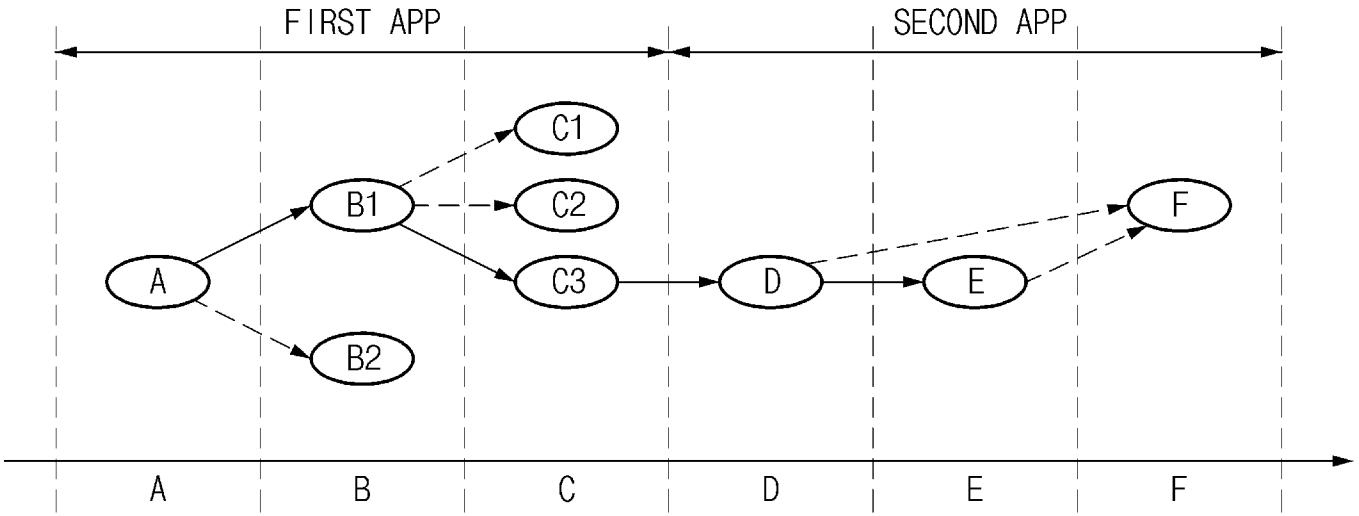
FIG. 7 is a view illustrating a path rule generating method of a natural language understanding (NLU) module, according to an embodiment of the disclosure.

FIG. 7 is a diagram illustrating a path rule generating method of a path planner module, according to an embodiment of the disclosure.

Referring to FIG. 7, according to an embodiment, the NLU module 220 may divide the function of an app into any one action (e.g., state A to state F) and may store the divided unit actions in the PR DB 231. For example, the NLU module 220 may store a path rule set including a plurality of path rules A-B1-C1, A-B1-C2, A-B1-C3-D-F, and A-B1-C3-D-E-F, which are divided into actions (e.g., states), in the PR DB 231.

According to an embodiment, the PR DB 231 of the path planner module 230 may store the path rule set for performing the function of an app. The path rule set may include a plurality of path rules, each of which includes a plurality of actions (e.g., a sequence of states). The action executed depending on a parameter input to each of the plurality of actions may be sequentially arranged in each of the plurality of path rules. According to an embodiment, the plurality of path rules implemented in a form of ontology or a graph model may be stored in the PR DB 231.

According to an embodiment, the NLU module 220 may select an optimal path rule A-B1-C3-D-F of the plurality of path rules A-B1-C1, A-B1-C2, A-B1-C3-D-F, and A-B1-C3-D-E-F corresponding to the intent of a user input and the parameter.

According to an embodiment, when there is no path rule completely matched to the user input, the NLU module 220 may deliver a plurality of rules to the user terminal 100. For example, the NLU module 220 may select a path rule (e.g., A-B1) partly corresponding to the user input. The NLU module 220 may select one or more path rules (e.g., A-B1-C1, A-B1-C2, A-B1-C3-D-F, and A-B1-C3-D-E-F) including the path rule (e.g., A-B1) partly corresponding to the user input and may deliver the one or more path rules to the user terminal 100.

According to an embodiment, the NLU module 220 may select one of a plurality of path rules based on an input added by the user terminal 100 and may deliver the selected one path rule to the user terminal 100. For example, the NLU module 220 may select one path rule (e.g., A-B1-C3-D-F) of the plurality of path rules (e.g., A-B1-C1, A-B1-C2, A-B1-C3-D-F, and A-B1-C3-D-E-F) depending on the user input (e.g., an input for selecting C3) additionally entered by the user terminal 100 for the purpose of transmitting the selected one path rule to the user terminal 100.

According to another embodiment, the NLU module 220 may determine the intent of a user and the parameter corresponding to the user input (e.g., an input for selecting C3) additionally entered by the user terminal 100 for the purpose of transmitting the user intent or the parameter to the user terminal 100. The user terminal 100 may select one path rule (e.g., A-B1-C3-D-F) of the plurality of path rules (e.g., A-B1-C1, A-B1-C2, A-B1-C3-D-F, and A-B1-C3-D-E-F) based on the transmitted intent or the transmitted parameter.

As such, the user terminal 100 may complete the actions of the apps 141 and 143 based on the selected one path rule.

According to an embodiment, when a user input in which information is insufficient is received by the intelligence server 200, the NLU module 220 may generate a path rule partly corresponding to the received user input. For example, the NLU module 220 may transmit the partly corresponding path rule to the intelligence agent 145. The processor 150 may execute the intelligence agent 145 to receive the path rule and may deliver the partly corresponding path rule to the execution manager module 147. The processor 150 may execute the first app 141 depending on the path rule through the execution manager module 147. The processor 150 may transmit information about an insufficient parameter to the intelligence agent 145 through the execution manager module 147 while executing the first app 141. The processor 150 may make a request for an additional input to a user, using the information about the insufficient parameter, through the intelligence agent 145. When the additional input is received by the user through the intelligence agent 145, the processor 150 may transmit and process a user input to the intelligence server 200. The NLU module 220 may generate a path rule to be added, based on the intent of the user input additionally entered and parameter information and may transmit the path rule to be added, to the intelligence agent 145. The processor 150 may transmit the path rule to the execution manager module 147 through the intelligence agent 145 to execute the second app 143.

According to an embodiment, when a user input, in which a part of information is missing, is received by the intelligence server 200, the NLU module 220 may transmit a user information request to the personalization information server 300. The personalization information server 300 may transmit information of a user entering the user input stored in a persona database to the NLU module 220. The NLU module 220 may select a path rule corresponding to the user input in which a part of an action is partly missing, by using the user information. As such, even though the user input in which a portion of information is missing is received by the intelligence server 200, the NLU module 220 may make a request for the missing information to receive an additional input or may determine a path rule corresponding to the user input by using user information.

According to an embodiment, Table 1 attached below may indicate an exemplary form of a path rule associated with a task that a user requests.

TABLE 1

| Path rule ID | State | Parameter |
|---|---|---|
| Gallery_101 | pictureView(25) | NULL |
| | searchView(26) | NULL |
| | searchViewResult(27) | Location, time |
| | SearchEmptySelectedView(28) | NULL |
| | SearchSelectedView(29) | ContentType, selectall |
| | CrossShare(30) | anaphora |

Referring to Table 1, a path rule that is generated or selected by an intelligence server (the intelligence server 200 of FIG. 1) depending on user speech (e.g., "please share a picture") may include at least one state 25, 26, 27, 28, 29 or 30. For example, the at least one state (e.g., one operating state of a terminal) may correspond to at least one of picture application execution PicturesView 25, picture search function execution SearchView 26, search result display screen output SearchViewResult 27, search result display screen output, in which a picture is non-selected, SearchEmptySelectedView 28, search result display screen output, in which at least one picture is selected, SearchSelectedView 29, or share application selection screen output CrossShare 30.

In an embodiment, parameter information of the path rule may correspond to at least one state. For example, it is possible to be included in the state of SearchSelectedView 29, in which at least one picture is selected.

The task (e.g., "please share a picture!") that the user requests may be performed depending on the execution result of the path rule including the sequence of the states 25, 26, 27, 28, and 29.

Figure 8:
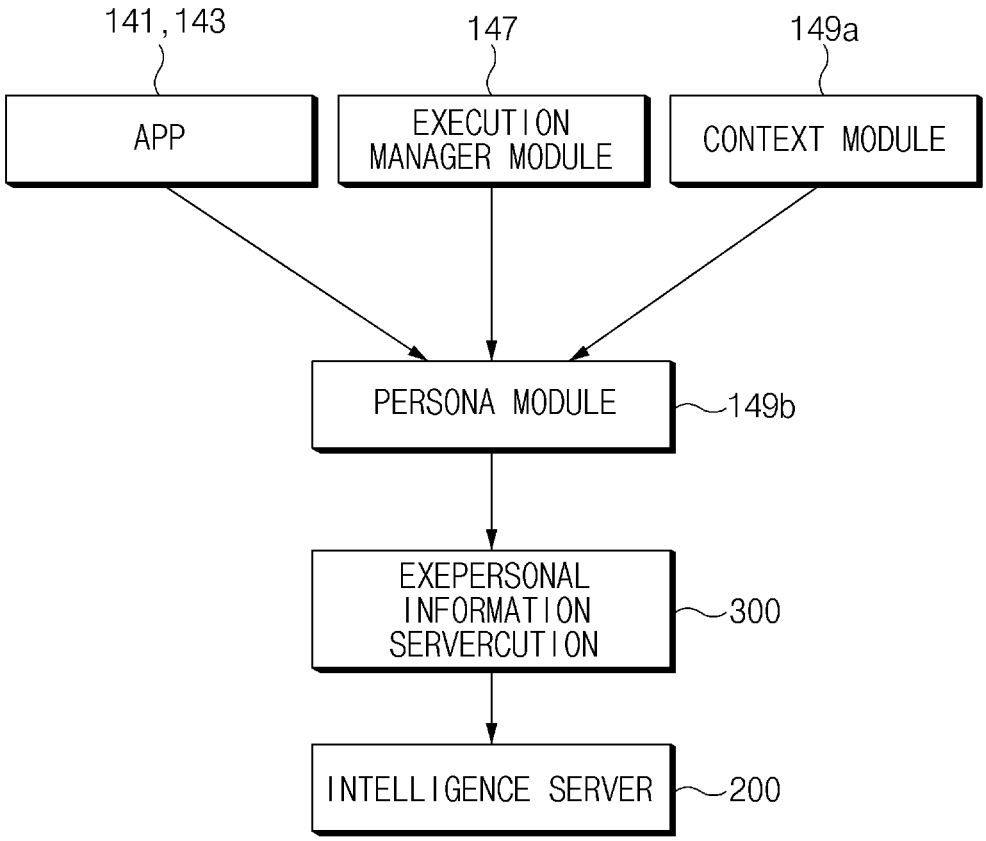
FIG. 8 is a diagram illustrating that a persona module of an intelligence service module manages information of a user, according to an embodiment of the disclosure.

FIG. 8 is a diagram illustrating that a persona module of an intelligence service module manages information of a user, according to an embodiment of the disclosure.

The processor 150 may implement various modules by executing the instructions stored in the memory 140. For example, the processor 150 may implement the apps 141 and 143, the execution manager module 147, the context module 149*a*, and the persona module 149*b*. Accordingly, it is understood that the operation executed by the apps 141 and 143, the execution manager module 147, the context module 149*a*, and the persona module 149*b* is executed by the processor 150. Referring to FIG. 8, the persona module 149*b* may receive information of the user terminal 100 from the apps 141 and 143, the execution manager module 147, or the context module 149*a*. The apps 141 and 143 and the execution manager module 147 may store information about the result obtained by executing the actions 141*b* and 143*b* of an app in an action log database. The context module 149*a* may store information about a current state of the user terminal 100 in a context database. The persona module 149*b* may receive the stored information from the action log database or the context database. For example, data stored in the action log database and the context database may be analyzed by an analysis engine and may be transmitted to the persona module 149*b*.

According to an embodiment, the persona module 149*b* may transmit information received from the apps 141 and 143, the execution manager module 147, or the context module 149*a* to the suggestion module 149*c*. For example, the persona module 149*b* may transmit the data stored in the action log database or the context database to the suggestion module 149*c*.

According to an embodiment, the persona module 149*b* may transmit the information received from the apps 141 and 143, the execution manager module 147, or the context module 149*a* to the personalization information server 300. For example, the persona module 149*b* may periodically transmit the data, which is accumulated and stored in the action log database or the context database, to the personalization information server 300.

According to an embodiment, the persona module 149*b* may transmit the data stored in the action log database or the context database to the suggestion module 149*c*. The user information generated by the persona module 149*b* may be stored in a persona database. The persona module 149*b* may periodically transmit the user information stored in the persona database to the personalization information server 300. According to an embodiment, the information transmitted to the personalization information server 300 by the persona module 149*b* may be stored in the persona database. The personalization information server 300 may infer user information necessary to generate a path rule of the intelligence server 200, using the information stored in the persona database.

According to an embodiment, the user information inferred using the information transmitted by the persona module 149*b* may include profile information or preference information. The profile information or the preference information may be inferred through an account of the user and accumulated information.

The profile information may include personal information of the user. For example, the profile information may include demographic information of the user. For example, the demographic information may include gender, age, or the like of the user. For another example, the profile information may include life event information. For example, the life event information may be inferred by comparing log information with a life event model and may be reinforced by analyzing a behavior pattern. For another example, the profile information may include interest information. For example, the interest information may include shopping items of interest, interesting fields (e.g., sports, politics, and the like). For another example, the profile information may include activity area information. For example, the activity area information may include information about a house, a work place, or the like. The information about the activity area may include information about an area where a priority is recorded based on accumulated stay time and the number of visits as well as information about a location of a place. For another example, the profile information may include activity time information. For example, the activity time information may include information about a wakeup time, a commute time, a sleep time, or the like. The information about the commute time may be inferred using the activity area information (e.g., information about a house and a workplace). The information about the sleep time may be inferred through a period during which the user terminal 100 is not used.

The preference information may include preference information of the user. For example, the preference information may include information about app preference. For example, the app preference may be inferred through a usage log (e.g., a time- and place-specific usage log) of an app. The app preference may be used to determine an app to be executed depending on a current state (e.g., time or place) of the user. For another example, the preference information may include information about contact preference. For example, the contact preference may be inferred by analyzing information about a contact frequency (e.g., a time- and place-specific frequency of contacting) of a contact. The contact preference may be used to determine a contact to be contacted depending on a current state (e.g., a contact for duplicate names) of the user. For another example, the preference information may include setting information. For example, the setting information may be inferred by analyzing information about setting frequency (e.g., a time- and place-specific frequency of setting a setting value) of a specific setting value. The setting information may be used to set a specific setting value depending on the current state (e.g., a time, a place, or a situation) of the user. For another example, the preference information may include place preference. For example, the place preference may be inferred through visit history (e.g., a time-specific visit history) of a specific place. The place preference may be used to determine a place to visit depending on the current state (e.g., time) of the user. For another example, the preference information may include instruction preference. For example, the instruction preference may be inferred through a usage frequency (e.g., a time- and place-specific usage frequency) of an instruction. The instruction preference may be used to determine an instruction pattern to be used depending on the current state (e.g., time or place) of the user. In particular, the instruction preference may include information about a menu most frequently selected by the user in the current state of an app being executed by analyzing the log information.

Figure 9:
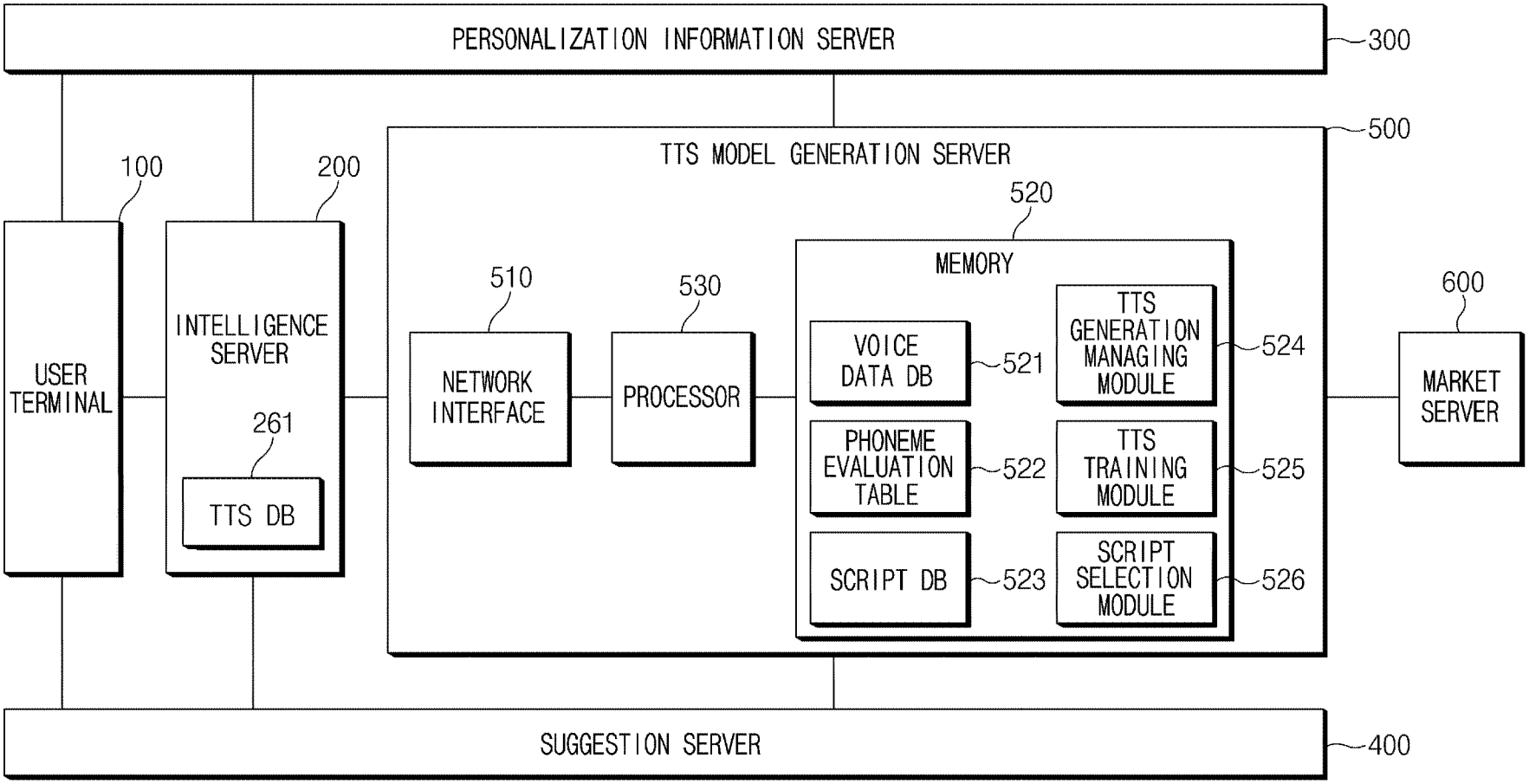
FIG. 9 is a diagram illustrating an integrated intelligence system including a text-to-speech (TTS) model generation server, according to an embodiment.

FIG. 9 is a diagram illustrating an integrated intelligence system including a text-to-speech (TTS) model generation server 500, according to an embodiment.

Referring to FIG. 9, an integrated intelligence system may include the user terminal 100, the intelligence server, the personalization information server 300, and the suggestion server 400 described above and may further include a TTS model generation server 500.

According to an embodiment, the user terminal 100 may include a wireless communication circuit and may communicate with the intelligence server 200, the personalization information server 300, the suggestion server 400, and the TTS model generation server 500 through the wireless communication circuit.

According to an embodiment, the intelligence server 200 may further include a TTS DB 261 that stores the TTS model generated by the TTS model generation server 500.

According to an embodiment, the intelligence server 200 may include the TTS model generation server 500. According to an embodiment, the intelligence server 200 including the TTS model generation server 500 may perform both the operation of the intelligence server 200 and the operation of the TTS model generation server 500. In an embodiment, the TTS DB 261 of the intelligence server 200 including the TTS model generation server 500 may include various DBs that the TTS model generation server 500 includes.

According to an embodiment, the TTS model generation server 500 may include a network interface 510, a memory 520, and a processor 530.

The network interface 510 may support the communication channel establishment between the user terminal 100, the intelligence server 200, the personalization information server 300, and the suggestion server 400 and the execution of wired or wireless communication through the established communication channel.

The memory may be electrically connected to the processor and may store instructions that implement operations that capable of being performed (or executed) by the processor. According to an embodiment, the memory may include a voice data DB 521, a phoneme evaluation table 522 and a script DB 523. According to an embodiment, the memory 520 may store a TTS generation managing module 524, a TTS training module 525, and a script selection module 526, which are implemented by the processor 150.

The voice data DB 521 may include the phoneme extracted by the processor 530 and voice data corresponding to the phoneme.

According to an embodiment, the voice data corresponding to the phoneme may be voice data corresponding to the phoneme in user utterance data used to extract the phoneme.

According to an embodiment, the voice data DB 521 may further include context information, the pitch of voice data, the spectrum of voice data, the duration of voice data, or the like.

According to an embodiment, the phoneme may include a single phoneme or n-phonemes obtained by combining a plurality of phonemes. For example, the phoneme extracted from voice data saying that "안녕하세요" may be "ㅏ, ㄴ, ㄴ, ㅕ, ㅇ, ㅎ, ㅏ, ㅅ, ㅔ and ㅛ". For another example, when the n-phonemes extracted from the voice data saying that "안녕하세요" is bi-phonemes, the n-phonemes may be "ㅏㅣ, ㄴㄴ, ㅣㅕ, ㅕㅇ, ㅇㅎ, ㅎㅏ, ㅏㅅ, ㅅㅔ, and ㅔㅛ". For another example, when the n-phonemes extracted from the voice data saying that "안녕하세요" is tri-phonemes, the n-phonemes may be "ㅏㄴㄴ, ㄴㄴㅕ, ㄴㅕㅇ, ㅕㅇㅎ, ㅇㅎㅏ, ㅎㅏㅅ, ㅏㅅㅔ, and ㅅㅔㅛ".

According to an embodiment of the disclosure, the phoneme evaluation table 522 may include a level associated with the phoneme stored in the voice data DB 521. According to an embodiment, the level of the phoneme may be a level associated with the number of phonemes stored in the voice data DB 521. For example, the level associated with the number of phonemes may include the number of types of phonemes stored in the voice data DB 521, the number of types of phonemes stored over the number of times preset in the voice data DB 521, the ratio of the number of types of phonemes stored in the voice data DB 521 to the number of all extractable phoneme types, the ratio of the number of types of phonemes, which are stored over the preset number of times, to the number of all extractable phoneme types, the minimum value among save counts for each type of a phoneme stored in the voice data DB 521, the number of times that a phoneme is stored in the voice data DB 521, or the like.

Table 2 illustrates a phoneme evaluation table according to an embodiment.

TABLE 2

| Phoneme | Level |
|---|---|
| ㅏ | 10 |
| ㄴ | 30 |
| ㅂ | 65 |
| ㅗ | 90 |

According to an embodiment, as illustrated in Table 2, the phoneme evaluation table may include a level associated with a phoneme.

According to an embodiment, the phoneme evaluation table 522 may include a level associated with n-phonemes stored in the voice data DB 521.

Table 3 illustrates a phoneme evaluation table according to an embodiment.

TABLE 3

| Phoneme | Level |
|---|---|
| ㅏㅣ | 90 |
| ㅣㅓㄹ | 10 |
| ㅂㅏㅣ | 70 |
| ㅂㅗ | 99 |

According to an embodiment, as illustrated in Table 3, the phoneme evaluation table may include a level associated with n-phonemes (e.g., bi-phonemes).

The script DB 523 may include scripts including the phoneme needed to generate the TTS model. For example, the script DB 523 may include a script saying that "결제 해줘" including a phoneme of "ㅓ" and may include a script saying that "문자 보내줘" including n-phonemes of "ㅁㅜㄴ".

According to an embodiment, the scripts included in the script DB 523 may include a word, a phrase, and/or a sentence. According to an embodiment, the script DB 523 may include a script including a request for performing a task. For example, the script DB 523 may include a script called "send me the just captured photo" including a request for performing a task to send a photo.

The processor 530 may be electrically connected to the network interface 510; the processor 530 may implement various modules by executing the instructions stored in the memory 520. For example, the processor 150 may implement a TTS generation managing module 524, a TTS training module 525, and a script selection module 526. Accordingly, it is understood that the operation executed by the TTS generation managing module 524, the TTS training module 525 and the script selection module 526 is executed by the processor 150.

According to an embodiment of the disclosure, the TTS generation managing module 524 may receive voice data and may control the generation of a TTS model, using the received voice data. According to an embodiment, the TTS generation managing module 524 may transmit the generated TTS model to the market server 600. According to an embodiment, the TTS generation managing module 524 may determine the completeness of the generated TTS model and may determine whether to update the TTS model in the TTS database.

According to an embodiment of the disclosure, the TTS training module 525 may generate the TTS model, using the received voice data. According to an embodiment, the TTS training module 525 may extract a phoneme from the received voice data and may determine voice data (e.g., a voice signal) corresponding to the extracted phoneme. The TTS training module 525 may store the extracted phoneme and the voice data corresponding to the extracted phoneme, in the voice data DB 521.

According to an embodiment, the TTS training module 525 may generate the TTS model for a unit junction-type TTS scheme. In the following description, it is assumed that the TTS training module 525 uses the unit junction-type TTS scheme. However, according to an embodiment, the TTS training module 525 may also use another scheme (e.g., unit selection-type TTS scheme) for generating a TTS model.

According to an embodiment of the disclosure, the script selection module 526 may determine the level associated with the phoneme stored in the voice data DB 521 and may store the determined level associated with the phoneme in the phoneme evaluation table 522. According to an embodiment, the script selection module 526 may determine which phoneme is needed to generate the TTS model, and may select a script for obtaining the required phoneme among a plurality of scripts stored in the script DB 523.

Figure 10:
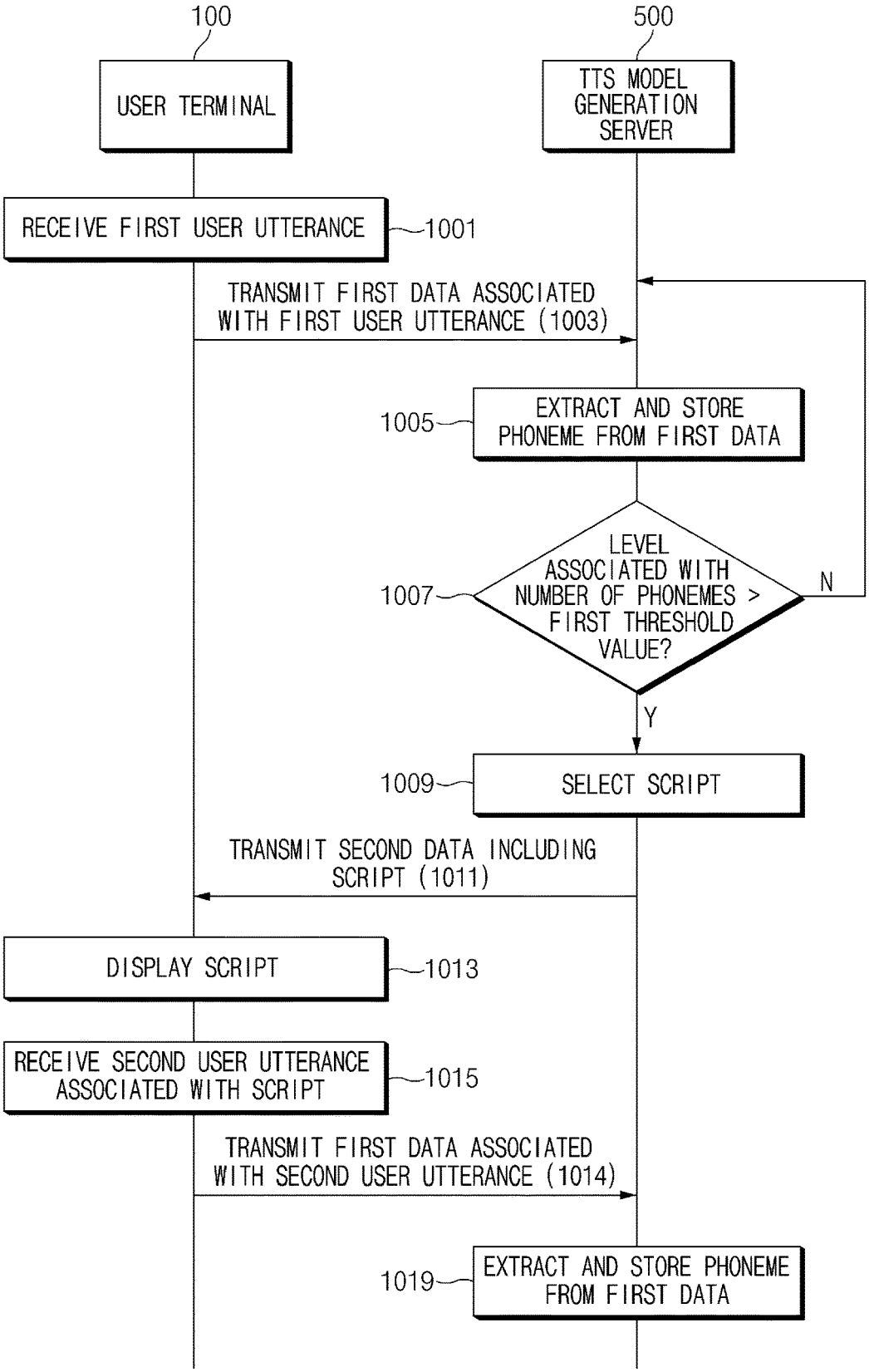
FIG. 10 is a flowchart illustrating a method of collecting a phoneme for generating a TTS model, according to an embodiment.

FIG. 10 is a flowchart illustrating a method of collecting a phoneme for generating a TTS model, according to an embodiment.

Hereinafter, the operations of the user terminal 100 and the TTS model generation server 500 will be described to collect a phoneme for generating a TTS model. According to an embodiment, when the intelligence server 200 includes the TTS model generation server 500, the TTS model generation server 500 of FIG. 10 may be replaced with the intelligence server 200 including the TTS model generation server 500.

According to an embodiment, when the TTS model generation server 500 is replaced with the intelligence server 200 including the TTS model generation server 500, the intelligence server 200 may perform an operation of receiving first data associated with a user utterance including a request for performing a task using the user terminal 100, an operation of determining a sequence of states of the user terminal 100 for performing a task based at least partly on the first data, and an operation of transmitting information about the sequence of states to the user terminal 100 via a network interface, as well as an operation illustrated in FIG. 10.

In operation 1001, the processor 150 of the user terminal 100 may receive a first user utterance through a microphone.

According to an embodiment, the first user utterance may include a request for performing a task using the user terminal 100.

In operation 1003, the processor 150 of the user terminal 100 may transmit the first data associated with a first user utterance to the TTS model generation server 500 via a wireless communication circuit. For example, the processor 150 of the user terminal 100 may transmit voice audio data corresponding to the first user utterance received through a microphone, to the TTS model generation server 500 through the wireless communication circuit.

In operation 1005, the processor 530 of the TTS model generation server 500 may extract a phoneme and a voice signal corresponding to the phoneme from the received first data and may store the extracted phoneme and the extracted voice signal.

For example, when the first data associated with the first user utterance saying that "문자 보내줘" is received, the processor 530 of the TTS model generation server 500 may extract ㅁ, ㅜ, ㄴ, ㅈ, ㅏ, ㅂ, ㅗ, ㄴ, ㅐ, ㅈ, and ㅜ, and a voice signal corresponding to each phoneme, from the first data and may store the extracted phonemes and the extracted voice signal corresponding to each phoneme in the memory 520 of the TTS model generation server 500.

In an embodiment, the processor 530 of the TTS model generation server 500 may extract n-phonemes (e.g., bi-phonemes or tri-phonemes) and a voice signal corresponding to the n-phonemes from the received first data and may store the extracted n-phonemes and the extracted voice signal.

For example, when the first data associated with the first user utterance saying that "문자 보내줘" is received, the processor 530 of the TTS model generation server 500 may extract 'ㅁㅜ, ㅜㅣ, ㄴㅈ, ㅈㅏ, ㅏㅂ, ㅂㅗ, ㅗㄴㅡ, ㄴㅐ, ㅐㅈ, and ㅈㅓ' and being bi-phonemes and the voice signal corresponding to each of the n-phonemes from the first data. The processor 530 of the TTS model generation server 500 may store the extracted n-phonemes and the extracted voice signal corresponding to each of the n-phonemes in the memory 520 of the TTS model generation server 500.

According to an embodiment, the processor 530 of the TTS model generation server 500 may determine a level associated with the number of stored phonemes. According to an embodiment, the level of the phoneme may be a level associated with the number of phonemes stored in the memory. For example, the level associated with the number of phonemes may include the number of types of phonemes stored in the memory, the number of types of phonemes stored over the number of times preset in the memory, the ratio of the number of types of phonemes stored in the memory to the number of all extractable phoneme types, the ratio of the number of types of phonemes, which are stored over the preset number of times, to the number of all extractable phoneme types, the minimum value among save counts for each type of a phoneme stored in the memory, the number of times that a phoneme is stored in the memory, or the like.

For example, when the processor 530 of the TTS model generation server 500 extracts and stores 'ㅁ, ㅜ, ㅣ, ㅈ, ㅏ, ㅂ, ㅗ, ㄴ, ㅐ, ㅈ, and ㅓ' from the first data, the number of types of phonemes stored in the memory is nine. When the preset number of times is two times, phonemes stored two or more times are 'ㅈ' and 'ㄴ', and thus the number of types of phonemes stored over the preset number of times is two.

In an embodiment, when the number of phoneme types capable of being extracted by the processor 530 of the TTS model generation server 500 is 100, the ratio of the number of types of phonemes, which is stored in the memory, to the number of all extractable phoneme types is 0.09, and the ratio of the number of types of phonemes, which is stored over the preset number of times, to all the extractable phoneme types is 0.02.

According to an embodiment, the minimum value among save counts for each type of a phoneme stored in the memory is 1, and the number of times that a phoneme is stored in the memory is 11 times.

When a level associated with the number of phonemes exceeds the first threshold value (operation 1007), in operation 1009, the processor 530 of the TTS model generation server 500 may select at least one script of a plurality of scripts stored in the memory.

According to an embodiment, the selected script may cause the user to generate an utterance for the purpose of increasing the number of types of phonemes stored in the memory or the save count of a phoneme for each type.

According to an embodiment, the processor 530 of the TTS model generation server 500 may select one or more scripts that include a phoneme corresponding to a pre-defined condition among all phonemes extractable from a plurality of scripts.

According to an embodiment, the pre-defined condition may be a condition for selecting a phoneme, which is stored the least number of times or of which the types is not stored, from among phonemes stored in the memory. In an embodiment, the pre-defined condition may be a phoneme, which is stored in the memory the least number of times, from among all phonemes capable of being extracted by the processor 530 of the TTS model generation server 500.

For example, the processor 530 of the TTS model generation server 500 may store a phoneme of 'ㅏㄴ' 35 times in the memory, may store a phoneme of 'ㄱㅕㄹ' 10 times in the memory, may store a phoneme of 'ㅢㅏㅣ' 50 times in the memory, and may store a phoneme of 'ㅂㅗ' 45 times in the memory. The plurality of scripts stored in the memory 520 of the TTS model generation server 500 may include "안녕하세요", "결과", "결과를 알려줘", "결제", "결제해줘", "문자", "문자 보내줘", and "메시지 보내줘". According to an embodiment, the processor 530 of the TTS model generation server 500 may select at least one of "결과", "하와이 사진 검색 결과를 알려줘", "결제", and "결제해줘", which are a script including a phoneme of 'ㄱㅕㄹ' stored the least number of times.

According to an embodiment, the selected script may be a word, a phrase, or a sentence.

In an embodiment, when the processor 530 of the TTS model generation server 500 selects a word, the processor 530 of the TTS model generation server 500 may select at least one of "결과" or "결제".

According to an embodiment, the processor 530 of the TTS model generation server 500 may select a script including a request for performing a task using the user terminal 100. For example, the processor 530 of the TTS model generation server 500 may select at least one of "하와이 사진 검색 결과를 알려줘" including a request for performing a task to search for a Hawaiian photo, using the user terminal 100 or "결제해줘" including a request for performing a task to make a payment, using a payment app.

According to an embodiment, the processor 530 of the TTS model generation server 500 may receive user personalization information from the user terminal 100 and may select a script including a request for performing a task associated with the received user personalization information.

According to an embodiment, the user personalization information may include result information obtained as the apps 141 and 143, which are stored in an action log database, and the execution manager module 147 execute the actions 141*b* and 143*b* of an app, information about the current state of the user terminal 100 included in a context database, personal information of a user in which the persona module 149*b* collects and manages the usage information or the execution result of the user terminal 100, or the like. For example, the user personalization information may include an application usage pattern, location information of the user, a text message history, or the like.

According to an embodiment, the processor 530 of the TTS model generation server 500 may predict the user's intent, using the user personalization information and may select a script including a request for performing a task corresponding to the predicted intent of the user.

For example, the user personalization information may include information indicating that the user makes a payment using a payment app at 7 am every day. Also, the phoneme corresponding to the pre-defined condition may be 'ㄱㅋㄹ'. The memory 520 of the TTS model generation server 500 may include a script of "안녕하세요", "결과", "결과를 알려줘", "결제", "결제해줘", "문자", "문자 보내줘", and "메시지 보내줘". In an embodiment, the processor 530 of the TTS model generation server 500 may receive the payment history text message recorded in the message application of the user terminal 100, from the user terminal 100. The processor 530 of the TTS model generation server 500 may obtain information indicating that the user makes a payment at 7 am every day, from the text message. The processor 530 of the TTS model generation server 500 may predict that the user makes a payment using a payment app at 7 am, using the obtained information. The processor 530 of the TTS model generation server 500 may select "결제해줘" that is a script including a request for performing a task to make a payment using the payment app, among "결과", "결과를 알려줘", "결제", and "결제해줘" that are a script including 'ㄱㅋㄹ'.

According to an embodiment, the processor 530 of the TTS model generation server 500 may receive the user personalization information from the suggestion server 400 via the network interface 510.

When the level associated with the number of phonemes is not greater than the first threshold value (operation 1007), in operation 1003, the processor 530 of the TTS model generation server 500 may receive the first data associated with the first user utterance from the user terminal 100.

In operation 1011, the processor 530 of the TTS model generation server 500 may transmit second data including the selected script to the user terminal 100 through the network interface 510.

According to an embodiment, the second data may further include a level associated with the number of phonemes stored in the memory 520 of the TTS model generation server 500.

In operation 1013, the processor 150 of the user terminal 100 may display one or more received scripts on the display.

According to an embodiment, the processor 150 of the user terminal 100 may further display the level associated with the number of received phonemes.

According to an embodiment, the processor 150 of the user terminal 100 may display a script, using the application associated with a voice command. For example, the processor 150 of the user terminal 100 may display the received script on the screen of an application (e.g., bixby of Samsung or siri of Apple) associated with the voice command.

In operation 1015, the processor 150 of the user terminal 100 may receive a second user utterance associated with the script via a microphone.

According to an embodiment, the second user utterance may be a voice utterance corresponding to the script displayed on the display of the user terminal 100.

In operation 1017, the processor 150 of the user terminal 100 may transmit the first data associated with a second user utterance to the TTS model generation server 500 via a wireless communication circuit.

According to an embodiment, the first data associated with the second user utterance may be a voice signal corresponding to the received second user utterance.

In an embodiment, when the processor 150 of the user terminal 100 receives second data including a plurality of scripts in operation 1011, the processor 150 of the user terminal 100 may display a plurality of scripts in operation 1013 and may receive the second user utterance associated with each of the plurality of scripts in operation 1015. According to an embodiment, in operation 1017, the first data associated with the transmitted second user utterance may include information about a script corresponding to each second user utterance. For example, the first data associated with the second user utterance may include a script corresponding to each second user utterance, a script number corresponding to each second user utterance, or the like.

In operation 1019, the processor 530 of the TTS model generation server 500 may extract a phoneme and a voice signal corresponding to the phoneme from the received first data and may store the extracted phoneme and the extracted voice signal.

According to an embodiment, embodiments capable of being applied to operation 1005 may be also applied to operation 1019.

According to an embodiment, when the first data associated with the second user utterance transmitted in operation 1017 includes information about the script corresponding to each second user utterance, the processor 530 of the TTS model generation server 500 may extract a phoneme and the voice signal corresponding to the phoneme, using a voice signal corresponding to each received second user utterance and a script corresponding to each second user utterance and may store the extracted phoneme and the extracted voice signal.

Figure 11:
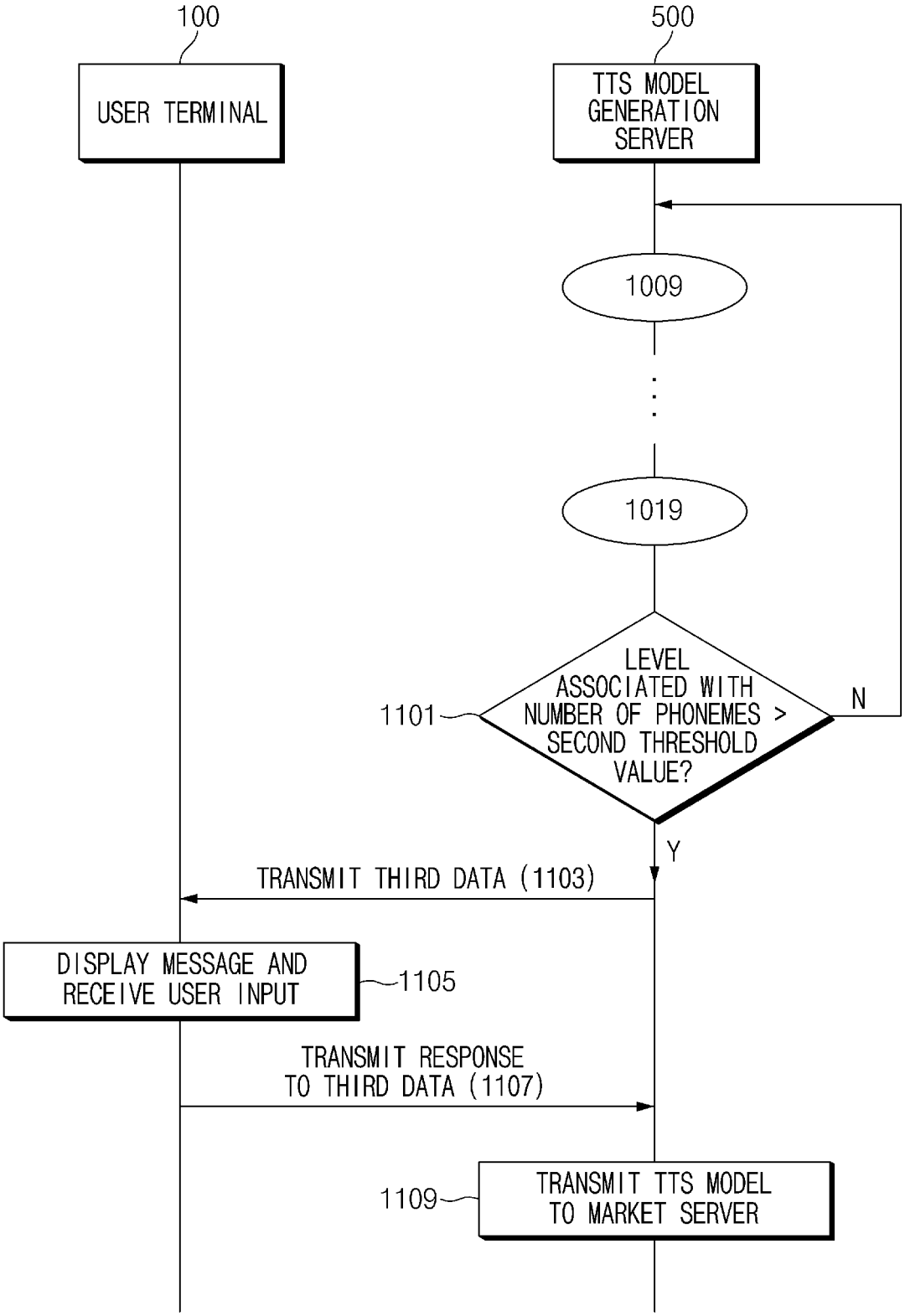
FIG. 11 is a flowchart illustrating a method of transmitting a TTS model to a market server, according to an embodiment.

FIG. 11 is a flowchart illustrating a method of transmitting a TTS model to a market server, according to an embodiment.

According to an embodiment, the operations illustrated in FIG. 11 may be performed in succession to operation 1019 described above.

According to an embodiment, when a level associated with the number of phonemes is not greater than a second threshold value, the processor 530 of the TTS model generation server 500 may again perform operation 1009 described with reference to FIG. 10. According to an embodiment, after operation 1009, the processor 150 of the user terminal 100 and the processor 530 of the TTS model generation server 500 may perform operation 1011 to operation 1019.

According to an embodiment, when the level associated with the number of phonemes is not greater than the second threshold value, the processor 150 of the user terminal 100 and the processor 530 of the TTS model generation server 500 may perform operation 1001 to operation 1019 again.

According to an embodiment, when the level associated with the number of phonemes exceeds the second threshold value (operation 1101), in operation 1103, the processor 530 of the TTS model generation server 500 may transmit third data indicating that the generation of a TTS model is completed, to the user terminal 100 through the network interface 510.

According to an embodiment, the third data may include a message for asking whether to transmit a TTS model to the market server 600. According to an embodiment, the market server 600 may receive and store the TTS model and may transmit the stored TTS model to the other user terminal 100 in response to the request of the other user terminal 100.

For example, the market server 600 may include a Galaxy apps server, a play store server, or the like.

According to an embodiment, the third data may include a level associated with the number of phonemes stored in the memory 520 of the TTS model generation server 500.

According to an embodiment, when the level associated with the number of phonemes is not greater than the second threshold value (operation 1101), the processor 530 of the TTS model generation server 500 may perform operation 1003 or 1009 described above. For example, when the level associated with the number of phonemes is not greater than a first threshold value, the processor 530 of the TTS model generation server 500 may perform operation 1003. For another example, when the level associated with the number of phonemes exceeds the first threshold value, the processor 530 of the TTS model generation server 500 may perform operation 1009.

In operation 1105, the processor 150 of the user terminal 100 may display a message indicating that the TTS model generation is completed based on the received third data, and an object associated with whether the TTS model is uploaded, on the touch screen display and may receive a user input to select the object.

According to an embodiment, the third data may include a message indicating that the TTS model generation is completed; the processor 150 of the user terminal 100 may display a message included in the third data on the touch screen display.

According to an embodiment, when the third data includes the level associated with the number of phonemes stored in the memory 520 of the TTS model generation server 500, the processor 150 of the user terminal 100 may determine whether the level exceeds the second threshold value. When the level exceeds the second threshold value, the processor 150 of the user terminal 100 may display a message, which is stored in the memory of the user terminal 100 and which indicates that the TTS model generation is completed.

According to an embodiment, the processor 150 of the user terminal 100 may display an object corresponding to transmitting the TTS model and an object corresponding to not transmitting the TTS model, on the touch screen display.

According to an embodiment, the processor 150 of the user terminal 100 may receive a user input to select the object corresponding to transmitting the TTS model or the object corresponding to not transmitting the TTS model, through the touch screen display.

In operation 1107, the processor 150 of the user terminal 100 may transmit a response to the third data based on the received user input, to the TTS model generation server 500 through a wireless communication circuit.

In operation 1109, the processor 530 of the TTS model generation server 500 may transmit the TTS model to the market server 600 through the network interface 510 based on the received response.

According to an embodiment, when the received response is a response corresponding to transmitting the TTS model, the processor 530 of the TTS model generation server 500 may transmit the generated TTS model to the market server 600. In an embodiment, the TTS model may include the phoneme stored in the voice data DB 521 and voice data corresponding to the phoneme.

According to an embodiment, when the received response is a response corresponding to transmitting the TTS model, the processor 530 of the TTS model generation server 500 may transmit a request to the intelligence server 200 such that the intelligence server 200 transmits the TTS model stored in the TTS DB 261 to the market server 600.

Figure 12A:
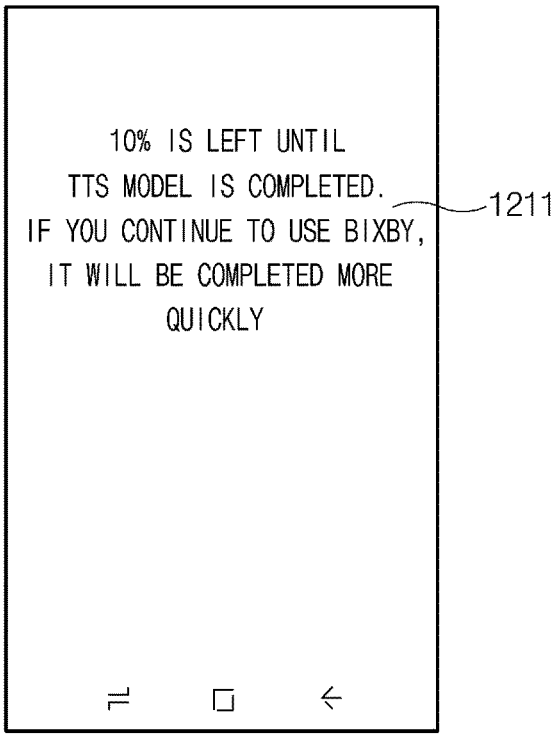
FIG. 12A illustrates a screen displayed by a user terminal when the level associated with the number of phonemes exceeds a first threshold value, according to an embodiment.

FIG. 12A illustrates a screen displayed by the user terminal 100 when a level associated with the number of phonemes exceeds a first threshold value, according to an embodiment.

Referring to FIG. 12A, the processor 150 of the user terminal 100 may display a message 1211 indicating a level associated with the number of received phonemes, on a display. In the embodiment of FIG. 12A, the processor 150 of the user terminal 100 may display a message 1211 indicating that a level associated with the number of received phonemes is 90% and 10% is left until the TTS model is completed, on the display.

Figure 12B:
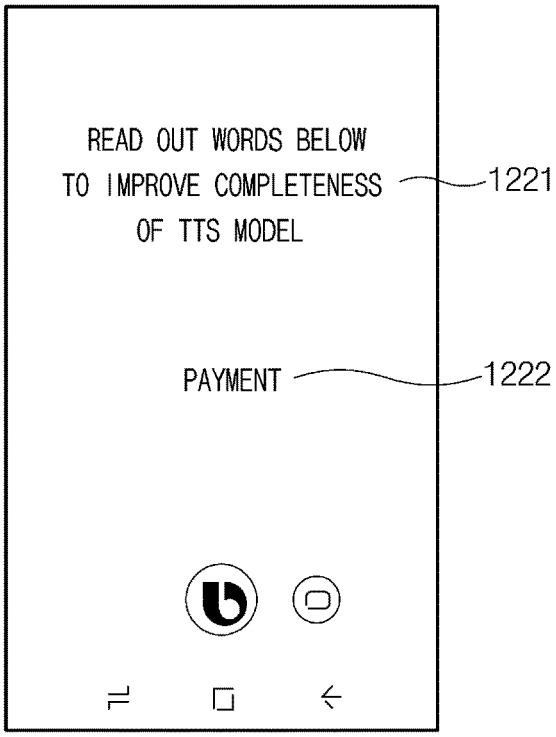
FIG. 12B illustrates a screen displaying a message for inducing a word including a phoneme satisfying a predefined condition to be uttered, according to an embodiment.

FIG. 12B illustrates a screen displaying a message for inducing a word including a phoneme satisfying a predefined condition to be uttered, according to an embodiment.

Referring to FIG. 12B, the processor 150 of the user terminal 100 may display a guide message 1221 for inducing a text, which is displayed on a display, to be uttered and a text 1222 received from the TTS model generation server 500, on the display. In the embodiment of FIG. 12B, the processor 150 of the user terminal 100 may receive second data including a word of "payment" from the TTS model generation server 500 and then may display the word 1222 of "payment" on the display.

Figure 12C:
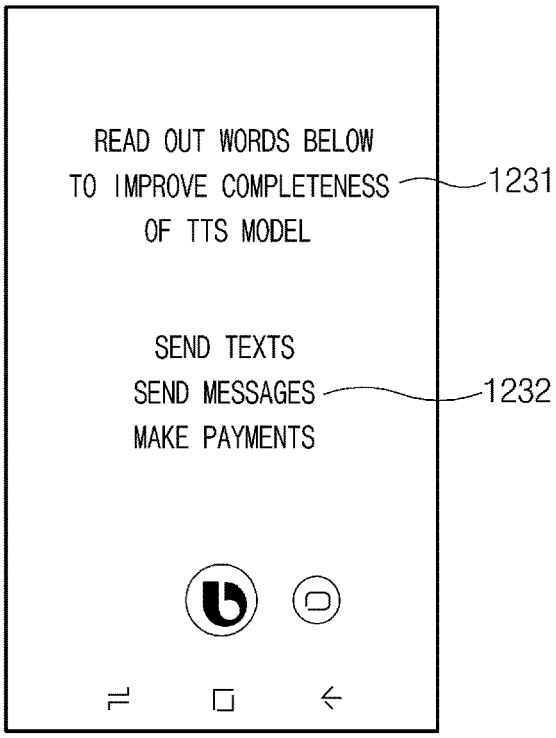
FIG. 12C illustrates a screen displaying a message for inducing a sentence including a phoneme satisfying a predefined condition to be uttered, according to an embodiment.

FIG. 12C illustrates a screen displaying a message for inducing a sentence including a phoneme satisfying a predefined condition to be uttered, according to an embodiment.

Referring to FIG. 12C, the processor 150 of the user terminal 100 may display a guide message 1231 for inducing a text displayed on a display to be uttered and a text 1232 received from the TTS model generation server 500, on a display. In the embodiment of FIG. 12B, the processor 150 of the user terminal 100 may receive second data including a sentence saying that "send a text", "send a message", and "make a payment", from the TTS model generation server 500. The processor 150 of the user terminal 100 may display the sentence 1232 saying that "send a text", "send a message", and "make a payment", on the display.

Figure 12D:
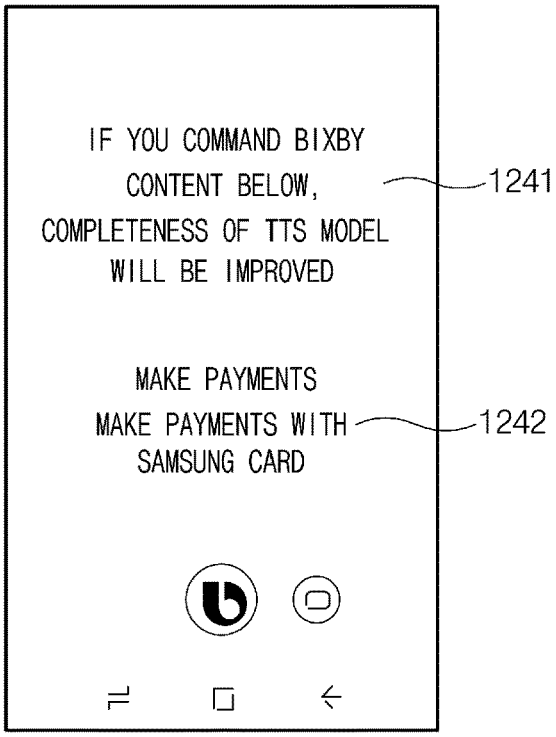
FIG. 12D illustrates a screen displaying a message for inducing a command sentence including a phoneme associated with user personalization information to be uttered, according to an embodiment.

FIG. 12D illustrates a screen displaying a message for inducing a command sentence including a phoneme associated with user personalization information to be uttered, according to an embodiment.

Referring to FIG. 12D, the processor 150 of the user terminal 100 may display a guide message 1241 for inducing a text displayed on a display to be uttered and a text 1242 received from the TTS model generation server 500, on a display. In the embodiment of FIG. 12D, the processor 150 of the user terminal 100 may receive second data including a command sentence saying that "make a payment" and "make a payment with Samsung card", from the TTS model generation server 500. According to an embodiment, the command sentence may be scripts selected using information indicating that a user makes a payment at 7:00 am every day, which is obtained by the TTS model generation server 500 from the payment history text message received from the user terminal 100. The processor 150 of the user terminal 100 may display the sentence 1242 saying that "make a payment" and "make a payment with Samsung card", on the display.

Figure 13:
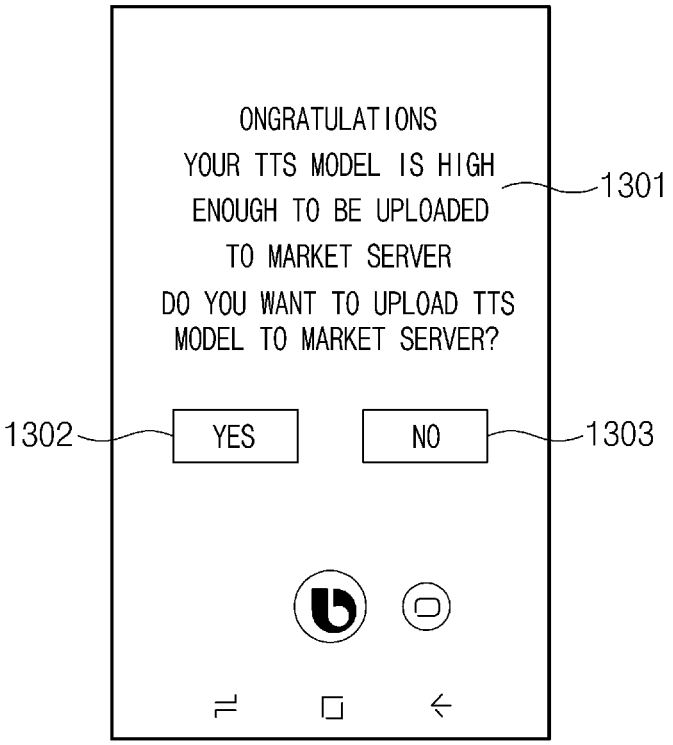
FIG. 13 illustrates a screen displaying a message for asking whether to transmit a TTS model to a market server, according to an embodiment.

FIG. 13 illustrates a screen displaying a message for asking whether to transmit a TTS model to a market server, according to an embodiment.

Referring to FIG. 13, the processor 150 of the user terminal 100 may display a message 1301 for providing a notification that the generation of a TTS model is completed and asking whether to transmit the generated TTS model to the market server 600, on a display. The processor 150 of the user terminal 100 may display an object 1302 corresponding to transmitting the TTS model and an object 1303 corresponding to not transmitting the TTS model, on a touch screen display.

According to an embodiment, the processor 150 of the user terminal 100 may receive a user input to select the object 1302 corresponding to transmitting the TTS model or the object 1303 corresponding to not transmitting the TTS model, through the touch screen display.

Figure 14:
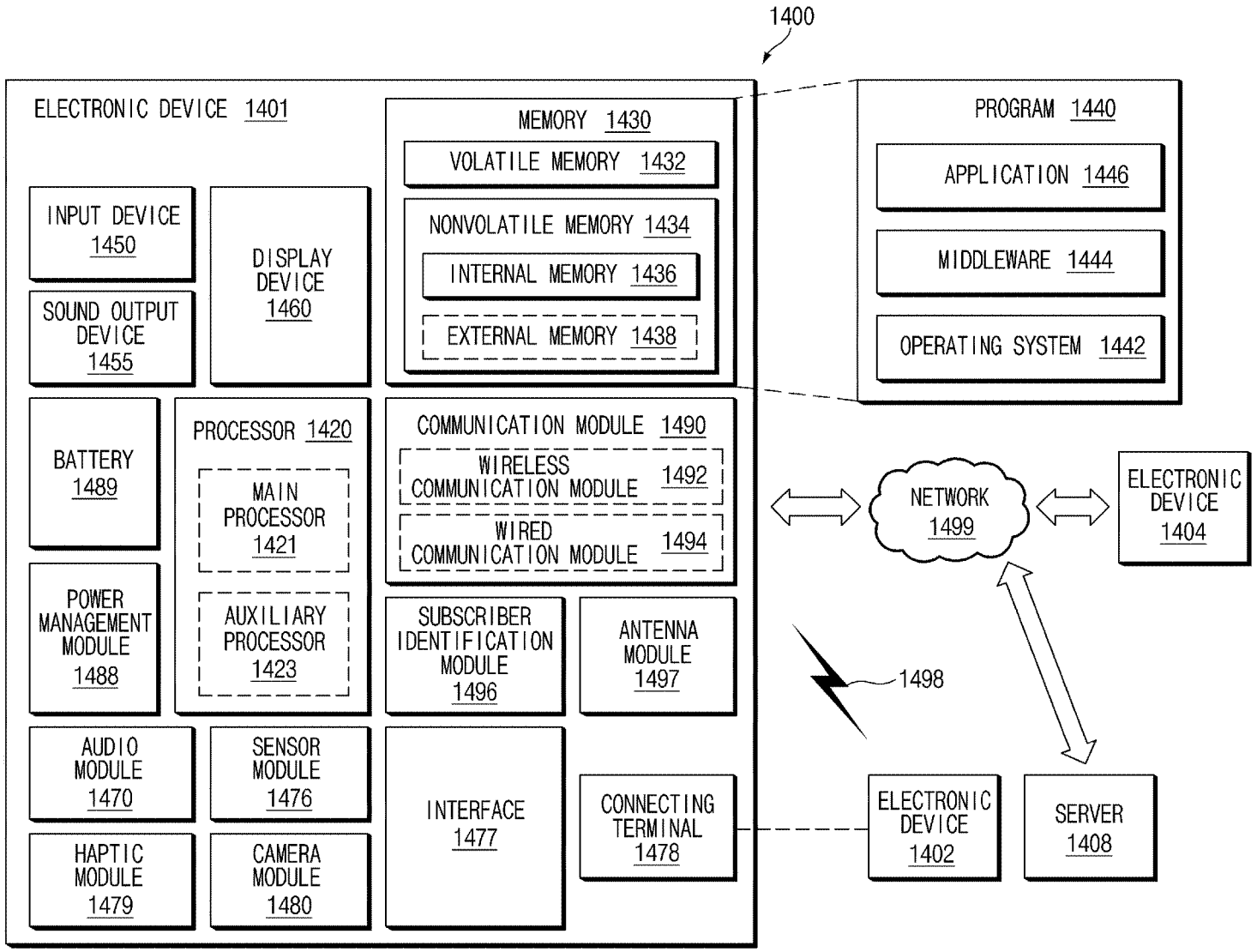
FIG. 14 is a block diagram of an electronic device in a network environment, according to various embodiments.

FIG. 14 is a block diagram of an electronic device 1401 in a network environment 1400 according to various embodiments. Referring to FIG. 14, the electronic device 1401 (e.g., the user terminal 100) may communicate with an electronic device 1402 through a first network 1498 (e.g., a short-range wireless communication) or may communicate with an electronic device 1404 or a server 1408 (e.g., the intelligence server 200, the personalization information server 300, the suggestion server 400, and the TTS model generation server 500) through a second network 1499 (e.g., a long-distance wireless communication) in the network environment 1400. According to an embodiment, the electronic device 1401 may communicate with the electronic device 1404 through the server 1408. According to an embodiment, the electronic device 1401 may include a processor 1420, a memory 1430, an input device 1450, a sound output device 1455, a display device 1460, an audio module 1470, a sensor module 1476, an interface 1477, a haptic module 1479, a camera module 1480, a power management module 1488, a battery 1489, a communication module 1490, a subscriber identification module 1495, and an antenna module 1497. According to some embodiments, at least one (e.g., the display device 1460 or the camera module 1480) among components of the electronic device 1401 may be omitted or other components may be added to the electronic device 1401. According to some embodiments, some components may be integrated and implemented as in the case of the sensor module 1476 (e.g., a fingerprint sensor, an iris sensor, or an illuminance sensor) embedded in the display device 1460 (e.g., a display).

The processor 1420 may operate, for example, software (e.g., a program 1440) to control at least one of other components (e.g., a hardware or software component) of the electronic device 1401 connected to the processor 1420 and may process and compute a variety of data. The processor 1420 may load a command set or data, which is received from other components (e.g., the sensor module 1476 or the communication module 1490), into a volatile memory 1432, may process the loaded command or data, and may store result data into a nonvolatile memory 1434. According to an embodiment, the processor 1420 may include a main processor 1421 (e.g., a central processing unit or an application processor) and an auxiliary processor 1423 (e.g., a graphic processing device, an image signal processor, a sensor hub processor, or a communication processor), which operates independently from the main processor 1421, additionally or alternatively uses less power than the main processor 1421, or is specified to a designated function. In this case, the auxiliary processor 1423 may operate separately from the main processor 1421 or embedded.

In this case, the auxiliary processor 1423 may control, for example, at least some of functions or states associated with at least one component (e.g., the display device 1460, the sensor module 1476, or the communication module 1490) among the components of the electronic device 1401 instead of the main processor 1421 while the main processor 1421 is in an inactive (e.g., sleep) state or together with the main processor 1421 while the main processor 1421 is in an active (e.g., an application execution) state. According to an embodiment, the auxiliary processor 1423 (e.g., the image signal processor or the communication processor) may be implemented as a part of another component (e.g., the camera module 1480 or the communication module 1490) that is functionally related to the auxiliary processor 1423. The memory 1430 may store a variety of data used by at least one component (e.g., the processor 1420 or the sensor module 1476) of the electronic device 1401, for example, software (e.g., the program 1440) and input data or output data with respect to commands associated with the software. The memory 1430 may include the volatile memory 1432 or the nonvolatile memory 1434.

The program 1440 may be stored in the memory 1430 as software and may include, for example, an operating system 1442, a middleware 1444, or an application 1446.

The input device 1450 may be a device for receiving a command or data, which is used for a component (e.g., the processor 1420) of the electronic device 1401, from an outside (e.g., a user) of the electronic device 1401 and may include, for example, a microphone, a mouse, or a keyboard.

The sound output device 1455 may be a device for outputting a sound signal to the outside of the electronic device 1401 and may include, for example, a speaker used for general purposes, such as multimedia play or recordings play, and a receiver used only for receiving calls. According to an embodiment, the receiver and the speaker may be either integrally or separately implemented.

The display device 1460 may be a device for visually presenting information to the user and may include, for example, a display, a hologram device, or a projector and a control circuit for controlling a corresponding device. According to an embodiment, the display device 1460 may include a touch circuitry or a pressure sensor for measuring an intensity of pressure on the touch.

The audio module 1470 may convert a sound and an electrical signal in dual directions. According to an embodiment, the audio module 1470 may obtain the sound through the input device 1450 or may output the sound through an external electronic device (e.g., the electronic device 1402 (e.g., a speaker or a headphone)) wired or wirelessly connected to the sound output device 1455 or the electronic device 1401.

The sensor module 1476 may generate an electrical signal or a data value corresponding to an operating state (e.g., power or temperature) inside or an environmental state outside the electronic device 1401. The sensor module 1476 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 1477 may support a designated protocol wired or wirelessly connected to the external electronic device (e.g., the electronic device 1402). According to an embodiment, the interface 1477 may include, for example, an HDMI (high-definition multimedia interface), a USB (universal serial bus) interface, an SD card interface, or an audio interface.

A connecting terminal 1478 may include a connector that physically connects the electronic device 1401 to the external electronic device (e.g., the electronic device 1402), for example, an HDMI connector, a USB connector, an SD card connector, or an audio connector (e.g., a headphone connector).

The haptic module 1479 may convert an electrical signal to a mechanical stimulation (e.g., vibration or movement) or an electrical stimulation perceived by the user through tactile or kinesthetic sensations. The haptic module 1479 may include, for example, a motor, a piezoelectric element, or an electric stimulator.

The camera module 1480 may shoot a still image or a video image. According to an embodiment, the camera module 1480 may include, for example, at least one lens, an image sensor, an image signal processor, or a flash.

The power management module 1488 may be a module for managing power supplied to the electronic device 1401 and may serve as at least a part of a power management integrated circuit (PMIC).

The battery 1489 may be a device for supplying power to at least one component of the electronic device 1401 and may include, for example, a non-rechargeable (primary) battery, a rechargeable (secondary) battery, or a fuel cell.

The communication module 1490 may establish a wired or wireless communication channel between the electronic device 1401 and the external electronic device (e.g., the electronic device 1402, the electronic device 1404, or the server 1408) and support communication execution through the established communication channel. The communication module 1490 may include at least one communication processor operating independently from the processor 1420 (e.g., the application processor) and supporting the wired communication or the wireless communication. According to an embodiment, the communication module 1490 may include a wireless communication module 1492 (e.g., a cellular communication module, a short-range wireless communication module, or a GNSS (global navigation satellite system) communication module) (e.g., the wireless communication circuit of the user terminal 100) or a wired communication module 1494 (e.g., an LAN (local area network) communication module or a power line communication module) and may communicate with the external electronic device using a corresponding communication module among them through the first network 1498 (e.g., the short-range communication network such as a Bluetooth, a Wi-Fi direct, or an IrDA (infrared data association)) or the second network 1499 (e.g., the long-distance wireless communication network such as a cellular network, an internet, or a computer network (e.g., LAN or WAN)). The above-mentioned various communication modules 1490 may be implemented into one chip or into separate chips, respectively.

According to an embodiment, the wireless communication module 1492 may identify and authenticate the electronic device 1401 using user information stored in the subscriber identification module 1495 in the communication network.

The antenna module 1497 may include one or more antennas to transmit or receive the signal or power to or from an external source. According to an embodiment, the communication module 1490 (e.g., the wireless communication module 1492) may transmit or receive the signal to or from the external electronic device through the antenna suitable for the communication method.

Some components among the components may be connected to each other through a communication method (e.g., a bus, a GPIO (general purpose input/output), an SPI (serial peripheral interface), or an MIPI (mobile industry processor interface)) used between peripheral devices to exchange signals (e.g., a command or data) with each other.

According to an embodiment, the command or data may be transmitted or received between the electronic device 1401 and the external electronic device 1404 through the server 1408 connected to the second network 1499. Each of the electronic devices 1402 and 1404 may be the same or different types as or from the electronic device 1401. According to an embodiment, all or some of the operations performed by the electronic device 1401 may be performed by another electronic device or a plurality of external electronic devices. When the electronic device 1401 performs some functions or services automatically or by request, the electronic device 1401 may request the external electronic device to perform at least some of the functions related to the functions or services, in addition to or instead of performing the functions or services by itself. The external electronic device receiving the request may carry out the requested function or the additional function and transmit the result to the electronic device 1401. The electronic device 1401 may provide the requested functions or services based on the received result as is or after additionally processing the received result. To this end, for example, a cloud computing, distributed computing, or client-server computing technology may be used.

According to an embodiment disclosed in the disclosure, a system may include a network interface, at least one processor electrically connected to the network interface, and at least one memory electrically connected to the processor. The memory may store instructions that, when executed, cause the processor to perform at least one work, to store a phoneme extracted from the first data in a text-to-speech (TTS) database, and to determine whether a level associated with the number of the phoneme stored in the TTS database exceeds a first threshold value. The work may include receiving first data associated with a user utterance obtained through a microphone, from an external device including the microphone through the network interface, determining a sequence of states of the external device for performing the task, based at least partly on the first data, and transmitting information about the sequence of the states to the external device through the network interface. The user utterance may include a request for performing a task using the external device.

In an embodiment, the level associated with the number of the phoneme may include the number of types of the phoneme stored in the TTS database, the number of types of phonemes stored over the number of times preset in the TTS database, the ratio of the number of types of the phoneme stored in the TTS database to the number of all extractable phoneme types, the ratio of the number of types of phonemes, which are stored over the preset number of times, to the number of all extractable phoneme types, a minimum value among save counts for each type of a phoneme stored in the TTS database, or the number of times that a phoneme is stored in the TTS database.

In an embodiment, the phoneme may include a single phoneme or n-phonemes obtained by combining a plurality of phoneme.

In an embodiment, the instructions may cause the processor to provide second data to the external device through the network interface, based at least partly on the determination. The second data may include a text that causes a user to generate an utterance to increase the number of types of the stored phoneme or a save count of the phoneme for each type.

In an embodiment, the instructions may cause the processor to provide the second data to the external device when the level associated with the number of the phoneme exceeds a first threshold value.

In an embodiment, the memory may further include a script database including a plurality of scripts. The instructions may cause the processor to select a script including a phoneme, which corresponds to a pre-defined condition, from among all phonemes extractable from the plurality of scripts. The text may include the selected script.

In an embodiment, the pre-defined condition may be a phoneme, which is stored in the TTS database the least number of times, from among all the extractable phonemes.

In an embodiment, the instructions may cause the processor to select a script including a request for performing a task using the external device.

In an embodiment, the instructions may cause the processor to receive user personalization information from the external device through the network interface and to select a script including a request for performing a task based on the user personalization information.

In an embodiment, the instructions may cause the processor to cause the external device to display at least part of the text on a display associated with the external device or coupled with the external device.

In an embodiment, the instructions may cause the processor to determine whether the level associated with the number of the phoneme stored in the TTS database exceeds a second threshold value and to transmit the phoneme stored in the TTS database and first data corresponding to the phoneme to a market server when the level associated with the number of the phoneme exceeds the second threshold value.

In an embodiment, the instructions may cause the processor to provide the external device with third data indicating that TTS model generation is completed, through the network interface when the level associated with the number of the phoneme exceeds the second threshold value, to receive a response to the third data from the external device, and to transmit the phoneme stored in the TTS database and first data corresponding to the phoneme to a market server, based on the received response.

Furthermore, according to an embodiment disclosed in the disclosure, an electronic device may include a housing, a touch screen display disposed inside the housing and exposed through a first portion of the housing, a microphone disposed inside the housing and exposed through a second portion of the housing, a wireless communication circuit disposed inside the housing, a processor disposed inside the housing and electrically connected to the touch screen display, the microphone, and the wireless communication circuit, and a memory disposed inside the housing and electrically connected to the processor. The memory may store instructions that, when executed, cause the processor to receive first data including a text, which causes a user to generate an utterance to increase the number of types of a phoneme stored in an external server or a save count of the phoneme for each type, from the external server through the wireless communication circuit, to display the text through the touch screen display, to receive a user utterance associated with the displayed text, through the microphone, and to transmit second data associated with the received user utterance to an external server.

In an embodiment, the user utterance may include a request for performing a task using the electronic device.

In an embodiment, the instructions may cause the processor to receive third data indicating that TTS model generation is completed, from the external server through the wireless communication circuit, to display a message indicating that the TTS model generation is completed based on the third data, and an object for transmitting the TTS model to a market server on the touch screen display, to receive a user input to select the object through the touch screen display, and to transmit a response to the third data to the external server based on the user input.

Moreover, according to an embodiment disclosed in the disclosure, a system may include a network interface, at least one processor electrically connected to the network interface, and at least one memory electrically connected to the processor. The memory may store instructions that, when executed, cause the processor to receive first data associated with a user utterance from an external device through the network interface, to store a phoneme extracted from the first data, in a voice data DB, and to provide second data to the external device through the network interface when a level associated with the number of the phoneme stored in the voice data DB exceeds a first threshold value. The second data may include a text, which causes a user to generate an utterance to increase the number of types of the stored phoneme or a save count of the phoneme for each type.

In an embodiment, the memory may further include a script database including a plurality of scripts. The instructions may cause the processor to select a script including a phoneme, which corresponds to a pre-defined condition, from among all phonemes extractable from the plurality of scripts. The text may include the selected script.

In an embodiment, the instructions may cause the processor to select a script including a request for performing a task using the external device.

In an embodiment, the instructions may cause the processor to receive user personalization information from the external device through the network interface and to select a script including a request for performing a task based on the user personalization information.

In an embodiment, the instructions may cause the processor to determine whether the level associated with the number of the phoneme stored in the voice data DB exceeds a second threshold value and to transmit the phoneme stored in the voice data DB and first data corresponding to the phoneme to a market server when the level associated with the number of the phoneme exceeds the second threshold value.

The electronic device according to various embodiments disclosed in the disclosure may be various types of devices. The electronic device may include, for example, at least one of a portable communication device (e.g., a smartphone), a computer device, a portable multimedia device, a mobile medical appliance, a camera, a wearable device, or a home appliance. The electronic device according to an embodiment of the disclosure should not be limited to the above-mentioned devices.

It should be understood that various embodiments of the disclosure and terms used in the embodiments do not intend to limit technologies disclosed in the disclosure to the particular forms disclosed herein; rather, the disclosure should be construed to cover various modifications, equivalents, and/or alternatives of embodiments of the disclosure. With regard to description of drawings, similar components may be assigned with similar reference numerals. As used herein, singular forms may include plural forms as well unless the context clearly indicates otherwise. In the disclosure disclosed herein, the expressions "A or B", "at least one of A or/and B", "A, B, or C" or "one or more of A, B, or/and C", and the like used herein may include any and all combinations of one or more of the associated listed items. The expressions "a first", "a second", "the first", or "the second", used in herein, may refer to various components regardless of the order and/or the importance, but do not limit the corresponding components. The above expressions are used merely for the purpose of distinguishing a component from the other components. It should be understood that when a component (e.g., a first component) is referred to as being (operatively or communicatively) "connected," or "coupled," to another component (e.g., a second component), it may be directly connected or coupled directly to the other component or any other component (e.g., a third component) may be interposed between them.

The term "module" used herein may represent, for example, a unit including one or more combinations of hardware, software and firmware. The term "module" may be interchangeably used with the terms "logic", "logical block", "part" and "circuit". The "module" may be a minimum unit of an integrated part or may be a part thereof. The "module" may be a minimum unit for performing one or more functions or a part thereof. For example, the "module" may include an application-specific integrated circuit (ASIC).

Various embodiments of the disclosure may be implemented by software (e.g., the program 1440) including an instruction stored in a machine-readable storage media (e.g., an internal memory 1436 or an external memory 1438) readable by a machine (e.g., a computer). The machine may be a device that calls the instruction from the machine-readable storage media and operates depending on the called instruction and may include the electronic device (e.g., the electronic device 1401). When the instruction is executed by the processor (e.g., the processor 1420), the processor may perform a function corresponding to the instruction directly or using other components under the control of the processor. The instruction may include a code generated or executed by a compiler or an interpreter. The machine-readable storage media may be provided in the form of non-transitory storage media. Here, the term "non-transitory", as used herein, is a limitation of the medium itself (i.e., tangible, not a signal) as opposed to a limitation on data storage persistency.

According to an embodiment, the method according to various embodiments disclosed in the disclosure may be provided as a part of a computer program product. The computer program product may be traded between a seller and a buyer as a product. The computer program product may be distributed in the form of machine-readable storage medium (e.g., a compact disc read only memory (CD-ROM)) or may be distributed only through an application store (e.g., a Play Store™). In the case of online distribution, at least a portion of the computer program product may be temporarily stored or generated in a storage medium such as a memory of a manufacturer's server, an application store's server, or a relay server.

Each component (e.g., the module or the program) according to various embodiments may include at least one of the above components, and a portion of the above sub-components may be omitted, or additional other sub-components may be further included. Alternatively or additionally, some components (e.g., the module or the program) may be integrated in one component and may perform the same or similar functions performed by each corresponding components prior to the integration. Operations performed by a module, a programming, or other components according to various embodiments of the disclosure may be executed sequentially, in parallel, repeatedly, or in a heuristic method. Also, at least some operations may be executed in different sequences, omitted, or other operations may be added.

The invention claimed is:

1. A system comprising:

a network interface;

at least one processor electrically connected to the network interface; and at least one memory electrically connected to the processor, wherein the memory stores instructions that, when executed, cause the processor to:

perform at least one work, wherein the work includes:

receiving first data associated with a user utterance obtained through a microphone, from an external device including the microphone through the network interface, wherein the user utterance includes a request for performing a task using the external device;

determining a sequence of states of the external device for performing the task, based at least partly on the first data; and transmitting information about the sequence of the states to the external device through the network interface;

store a phoneme extracted from the first data in a text-to-speech (TTS) database;

determine whether a level associated with the number of the phoneme stored in the TTS database exceeds a first threshold value;

provide second data to the external device through the network interface, based at least partly on the determination; and wherein the second data includes a text that causes a user to generate an utterance to increase the number of types of the stored phoneme or a save count of the phoneme for each type.

2. The system of claim 1, wherein the level associated with the number of the phoneme includes:

the number of types of the phoneme stored in the TTS database, the number of types of phonemes stored over the number of times preset in the TTS database, the ratio of the number of types of the phoneme stored in the TTS database to the number of all extractable phoneme types, the ratio of the number of types of phonemes, which are stored over the preset number of times, to the number of all extractable phoneme types, a minimum value among save counts for each type of a phoneme stored in the TTS database, or the number of times that a phoneme is stored in the TTS database.

3. The system of claim 1, wherein the phoneme includes a single phoneme or n-phonemes obtained by combining a plurality of phoneme.

4. The system of claim 1, wherein the instructions cause the processor to:

when the level associated with the number of the phoneme exceeds the first threshold value, provide the second data to the external device.

5. The system of claim 1, wherein the memory further includes a script database including a plurality of scripts, wherein the instructions cause the processor to:

select a script including a phoneme, which corresponds to a pre-defined condition, from among all phonemes extractable from the plurality of scripts, and wherein the text includes the selected script.

6. The system of claim 5, wherein the pre-defined condition is a phoneme, which is stored in the TTS database the least number of times, from among all the extractable phonemes.

7. The system of claim 5, wherein the instructions cause the processor to:

select a script including the request for performing the task using the external device.

8. The system of claim 5, wherein the instructions cause the processor to:

receive user personalization information from the external device through the network interface; and select a script including a request for performing a task based on the user personalization information.

9. The system of claim 1, wherein the instructions cause the processor to:

cause the external device to display at least part of the text on a display associated with the external device or coupled with the external device.

10. The system of claim 1, wherein the instructions cause the processor to:

determine whether the level associated with the number of the phoneme stored in the TTS database exceeds a second threshold value; and when the level associated with the number of the phoneme exceeds the second threshold value, transmit the phoneme stored in the TTS database and first data corresponding to the phoneme to a market server.

11. The system of claim 10, wherein the instructions cause the processor to:

when the level associated with the number of the phoneme exceeds the second threshold value, provide the external device with third data indicating that TTS model generation is completed, through the network interface;

receive a response to the third data from the external device; and transmit the phoneme stored in the TTS database and the first data corresponding to the phoneme to the market server, based on the received response.

12. An electronic device comprising:

a housing;

a touch screen display disposed inside the housing and exposed through a first portion of the housing;

a microphone disposed inside the housing and exposed through a second portion of the housing;

a wireless communication circuit disposed inside the housing;

a processor disposed inside the housing and electrically connected to the touch screen display, the microphone, and the wireless communication circuit; and a memory disposed inside the housing and electrically connected to the processor, wherein the memory stores instructions that, when executed, cause the processor to:

receive first data including a text, which causes a user to generate an utterance to increase the number of types of a phoneme stored in an external server or a save count of the phoneme for each type, from the external server through the wireless communication circuit;

display the text through the touch screen display;

receive a user utterance associated with the displayed text, through the microphone;

transmit second data associated with the received user utterance to the external server for TTS model generation;

receive third data indicating that the TTS model generation is completed, from the external server through the wireless communication circuit; and display a message indicating that the TTS model generation is completed based on the third data.

13. The electronic device of claim 12, wherein the user utterance includes a request for performing a task using the electronic device.

14. The electronic device of claim 12, wherein the instructions cause the processor to:

display an object for transmitting the TTS model to a market server on the touch screen display;

receive a user input to select the object through the touch screen display; and transmit a response to the third data to the external server based on the user input.

* * * * *